US011173706B2

(12) United States Patent
Sugai

(10) Patent No.: US 11,173,706 B2
(45) Date of Patent: Nov. 16, 2021

(54) DROPLET DISCHARGE HEAD

(71) Applicant: SEIKO EPSON CORPORATION, Tokyo (JP)

(72) Inventor: Keigo Sugai, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/719,451

(22) Filed: Dec. 18, 2019

(65) Prior Publication Data

US 2020/0198329 A1 Jun. 25, 2020

(30) Foreign Application Priority Data

Dec. 21, 2018 (JP) ..... JP2018-239224

(51) Int. Cl.
*B41J 2/045* (2006.01)
*B41J 2/14* (2006.01)
*B41J 2/01* (2006.01)

(52) U.S. Cl.
CPC ..... *B41J 2/04541* (2013.01); *B41J 2/14233* (2013.01); *B41J 2/04581* (2013.01); *B41J 2002/14338* (2013.01); *B41J 2202/05* (2013.01)

(58) Field of Classification Search
CPC B41J 2/04541; B41J 2/14233; B41J 2202/05; B41J 2002/14338; B41J 2/04581
See application file for complete search history.

(56) References Cited

U.S. PATENT DOCUMENTS

| | | | | |
|---|---|---|---|---|
| 5,933,168 | A | 8/1999 | Sakai | |
| 2003/0122889 | A1* | 7/2003 | Okuda | B41J 2/04581 347/19 |
| 2011/0228012 | A1* | 9/2011 | Yoshida | B41J 2/14274 347/68 |
| 2012/0268511 | A1* | 10/2012 | Sasagawa | B41J 2/04588 347/10 |

FOREIGN PATENT DOCUMENTS

| | | | |
|---|---|---|---|
| JP | H09-327909 | A | 12/1997 |
| JP | 2000-141647 | A | 5/2000 |
| JP | 2013-180226 | A | 9/2013 |

* cited by examiner

*Primary Examiner* — Yaovi M Ameh
(74) *Attorney, Agent, or Firm* — Chip Law Group

(57) ABSTRACT

A droplet discharge head includes a plurality of nozzles, first liquid chambers communicating with the nozzles, a first inflow path for supplying a liquid to the first liquid chambers, a first actuator that individually changes pressures of the first liquid chambers, and a second actuator that changes pressures of a plurality of first liquid chambers in common, in which an expansion/contraction amount of the second actuator is larger than that of the first actuator.

10 Claims, 16 Drawing Sheets

DROPLET DISCHARGE HEAD

The present application is based on, and claims priority from JP Application Serial Number 2018-239224, filed Dec. 21, 2018, the disclosure of which is hereby incorporated by reference herein in its entirety.

BACKGROUND

1. Technical Field

The present disclosure relates to a droplet discharge head.

2. Related Art

An example of a droplet discharge head that discharges minute droplets is JP-A-9-327909 and the like. JP-A-9-327909 discloses a droplet discharge head that abruptly draws a meniscus m that draws a meniscus m stationary at a nozzle opening, displaces a central region mc of the meniscus relatively large toward a pressure generation chamber, contracts a pressure generation chamber to generate an inertia flow when the movement of the central region of the meniscus to the pressure generation chamber is reversed, concentrates the inertial flow on the central region of the meniscus near the pressure generation chamber side, and extrudes only the central region at a high speed to stably discharge ink droplets thinner than the diameter of the nozzle opening at a speed suitable for printing.

However, when the droplet discharge head described in the above document is applied to a high-viscosity liquid of 50 mPa or more, the following problems occur. When a high-viscosity liquid of 50 mPa or more is discharged, the energy required for separating the droplets from the meniscus is larger than that of a discharged liquid of the related art. Therefore, in the droplet discharge head described in JP-A-9-327909, it is necessary to increase "the amount of expansion and contraction of an actuator" or "the area where a vibration plate forms a pressure generation chamber" in order to increase the excluded volume generated by the expansion and contraction of the actuator. However, if the "the amount of expansion and contraction amount of the actuator" is increased, the frequency characteristics of the actuator will decrease, and the speed of pressurizing the liquid at the time of meniscus inversion will be slow, and therefore it is difficult to control the timing at which the meniscus is inverted according to the characteristics of the liquid such as temperature and viscosity. Increasing the "area where the vibration plate forms the pressure generation chamber" increases the volume of the pressure generation chamber, and the time for a pressure wave generated by the actuator contraction to propagate to the meniscus becomes longer, and therefore it is difficult to control the timing at which the meniscus is inverted according to the characteristics of the liquid such as temperature and viscosity.

SUMMARY

According to an aspect of the present disclosure, there is provided a droplet discharge head mounted on a droplet discharge apparatus including a control unit for controlling droplet discharge, the head including a first liquid chamber formed on a flow path forming substrate, a nozzle communicating with the first liquid chamber, a first inflow path for supplying a liquid to the first liquid chamber, a first vibration plate forming a part of a wall surface of the first liquid chamber, a second vibration plate forming a part of a wall surface of the first inflow path, a first actuator for displacing the first vibration plate to change a pressure in the first liquid chamber, and a second actuator for displacing the second vibration plate to change the pressure in the first liquid chamber, in which an excluded volume of the second actuator is larger than that of the first actuator, and based on a drive signal from the control unit, the second actuator is driven to draw a meniscus in the nozzle by depressurizing the inside of the first liquid chamber, and the first actuator is driven to discharge droplets from the nozzle by pressurizing the first liquid chamber.

According to another aspect of the present disclosure, there is provided a droplet discharge head mounted on a droplet discharge apparatus including a control unit for controlling droplet discharge, the head including a first liquid chamber formed on a flow path forming substrate, a nozzle communicating with the first liquid chamber, a first inflow path for supplying a liquid to the first liquid chamber, a first vibration plate forming a part of a wall surface of the first liquid chamber, a second vibration plate forming a part of a wall surface of the first liquid chamber, a first actuator for displacing the first vibration plate to change a pressure in the first liquid chamber, and a second actuator for displacing the second vibration plate to change the pressure in the first liquid chamber, in which an excluded volume of the second actuator is larger than that of the first actuator, and based on a drive signal from the control unit, the second actuator is driven to draw a meniscus in the nozzle by depressurizing the inside of the first liquid chamber, and the first actuator is driven to discharge droplets from the nozzle by pressurizing the first liquid chamber.

According to still another aspect of the present disclosure, there is provided a droplet discharge head mounted on a droplet discharge apparatus including a control unit for controlling droplet discharge, the head including a first liquid chamber formed on a flow path forming substrate, a nozzle communicating with the first liquid chamber, a first inflow path for supplying a liquid to the first liquid chamber, an outflow path communicating with the first liquid chamber or the nozzle and discharging the liquid, a first vibration plate forming a part of a wall surface of the first liquid chamber, a second vibration plate forming a part of a wall surface of the outflow path, a first actuator for displacing the first vibration plate to change a pressure in the first liquid chamber, and a second actuator for displacing the second vibration plate to change the pressure in the first liquid chamber, in which an excluded volume of the second actuator is larger than that of the first actuator, and based on a drive signal from the control unit, the second actuator is driven to draw a meniscus in the nozzle by depressurizing the inside of the first liquid chamber, and the first actuator is driven to discharge droplets from the nozzle by pressurizing the first liquid chamber.

According to still another aspect of the present disclosure, there is provided a droplet discharge head mounted on a droplet discharge apparatus including a control unit for controlling droplet discharge, the head including a first liquid chamber formed on a flow path forming substrate, a nozzle communicating with the first liquid chamber, a first inflow path for supplying a liquid to the first liquid chamber, a second inflow path for supplying the liquid to the nozzle, a first vibration plate forming a part of a wall surface of the first liquid chamber, a second vibration plate forming a part of a wall surface of the second inflow path, a first actuator for displacing the first vibration plate to change a pressure in the first liquid chamber, and a second actuator for displacing the second vibration plate to change a pressure in the nozzle, in which an excluded volume of the second actuator is larger than that of the first actuator, and based on a drive signal from the control unit, the second actuator is driven to draw a meniscus in the nozzle by depressurizing the inside of the nozzle, and the first actuator is driven to discharge droplets from the nozzle by pressurizing the first liquid chamber.

In the droplet discharge head, an expansion/contraction amount of the second actuator may be larger than that of the first actuator.

In the droplet discharge head, the second actuator may displace the second vibration plate via a displacement amplifying mechanism that increases a displacement amount of the second vibration plate with respect to an expansion/contraction amount of the second actuator.

In the droplet discharge head, the second vibration plate may be a diaphragm.

In the droplet discharge head, the second vibration plate may be a piston that reciprocates according to the expansion and contraction of the second actuator.

In the droplet discharge head, the area where the second vibration plate forms the wall surface of the first inflow path may be larger than the area where the first vibration plate forms the wall surface of the first liquid chamber.

In the droplet discharge head, the area where the second vibration plate forms the wall surface of the first liquid chamber may be larger than the area where the first vibration plate forms the wall surface of the first liquid chamber.

In the droplet discharge head, the area where the second vibration plate forms the wall surface of the outflow path may be larger than the area where the first vibration plate forms the wall surface of the first liquid chamber.

In the droplet discharge head, the area where the second vibration plate forms the wall surface of the second inflow path may be larger than the area where the first vibration plate forms the wall surface of the first inflow path.

In the droplet discharge head, a displacement amplifying mechanism includes a storage chamber in which a part of the wall surface is formed by the second vibration plate and a third vibration plate forming a part of the wall surface of a storage chamber, in which the area where the third vibration plate forms the wall surface of the storage chamber may be larger than the area where the first vibration plate forms the wall surface of the first liquid chamber, and the resonance frequency of the first actuator may be equal to the resonance frequency of the second actuator.

In the droplet discharge head, the resonance frequency of the first actuator may be equal to the resonance frequency of the second actuator.

In the droplet discharge head, the diameter of the droplet discharged from the nozzle may be less than two-thirds of the nozzle opening.

In the droplet discharge head, the speed at which the liquid column formed in the nozzle moves in the direction toward the nozzle opening may be higher than the speed at which the meniscus in the nozzle moves in the direction toward the nozzle opening.

DESCRIPTION OF EXEMPLARY EMBODIMENTS

Hereinafter, embodiments of the present disclosure will be described with reference to drawings. In the following drawings, the scale of each layer and each member is made different from an actual scale so that each layer and each member can be recognized.

Embodiment 1

Figure 1:
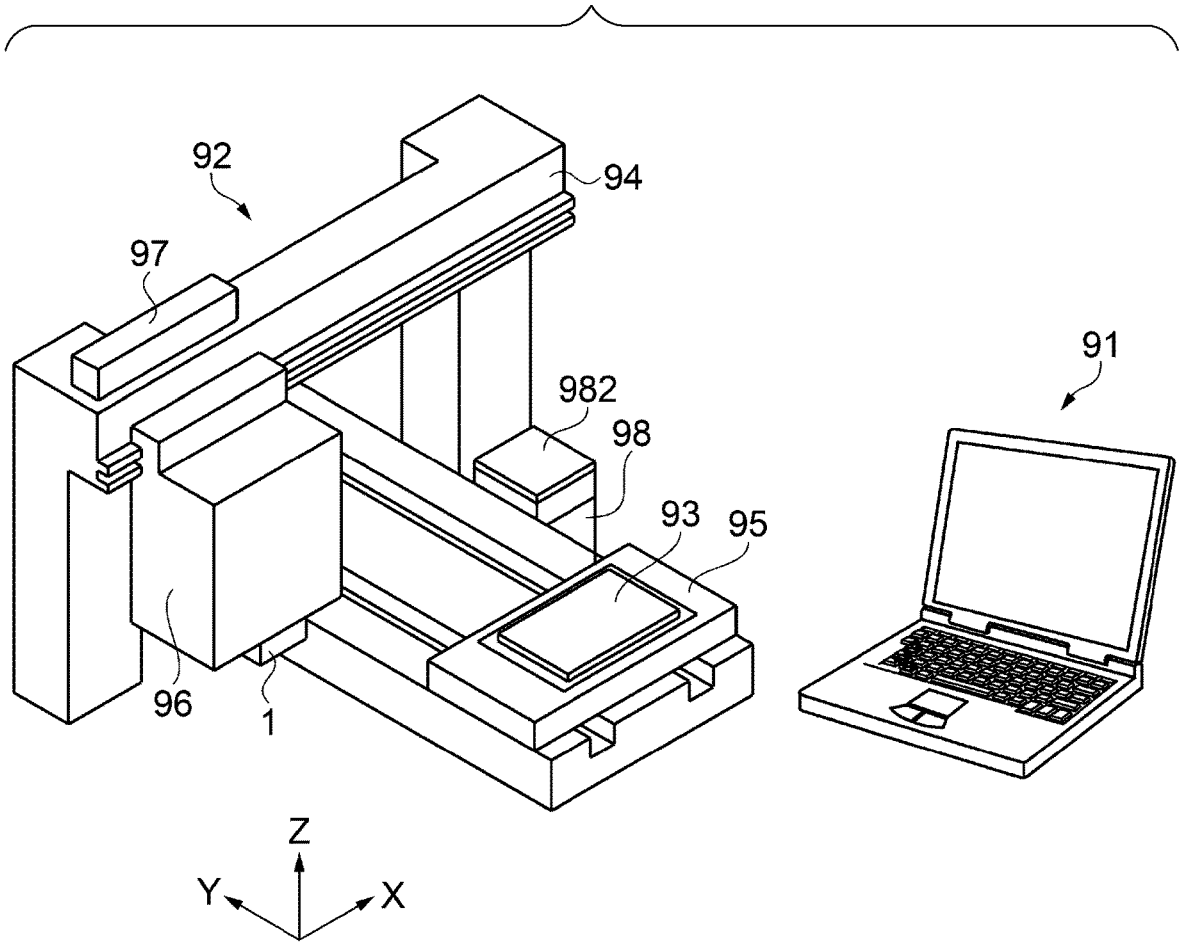
FIG. 1 is an explanatory diagram showing a schematic configuration of a droplet discharge apparatus according to Embodiment 1.

FIG. 1 is a diagram showing a schematic configuration of a droplet discharge apparatus according to Embodiment 1.

Schematic Configuration of Droplet Discharge Apparatus

FIG. 1 is a diagram showing a schematic configuration of a computer 91 and a droplet discharge apparatus 92 as a droplet discharge control apparatus constituting a printing system. The droplet discharge apparatus 92 forms a dot pattern on a recording medium 93 such as paper, cloth, film, wood, or ceramic plate. The computer 91 is communicably coupled to the droplet discharge apparatus 92. The computer 91 outputs drawing data corresponding to the image to the droplet discharge apparatus 92, and the droplet discharge apparatus 92 forms a dot pattern on the recording medium 93. A computer program such as an application program or a droplet discharge apparatus driver is installed in the computer 91.

The droplet discharge apparatus 92 includes a droplet discharge head 1, a control unit 61, a carriage moving mechanism 94, a recording medium transport mechanism 95, a carriage 96, a first tank 97, and a second tank 98. The control unit 61 will be described later.

In the droplet discharge head 1, a plurality of nozzles are arranged on the surface of the carriage 96 facing the recording medium 93 so as to intersect a carriage movement direction (X direction) and discharges the liquid onto the recording medium 93. The liquid may be a material in a state when a substance is in a liquid phase, and a liquid state material such as sol or gel is also included in the liquid. The liquid includes not only a liquid as one state of a substance but also a liquid in which particles of a functional material made of a solid such as a pigment or metal particles are dissolved, dispersed or mixed in a solvent. For example, ink, liquid crystal emulsifier, metal paste and the like can be mentioned.

The carriage moving mechanism 94 drives a motor 941 to move the carriage 96 including the droplet discharge head 1 in the X direction. The carriage 96 reciprocates in the X direction, and the droplet discharge head 1 discharges the liquid based on the drawing data so that the droplet discharge apparatus 92 forms a dot pattern on the recording medium 93. The recording medium transport mechanism 95 transports the recording medium 93 in a transport direction (Y direction) by the motor 951.

The first tank 97 stores the liquid supplied to the droplet discharge head 1 through a first inflow path 13. The first tank 97 also has a first pump 971. The first pump 971 pressurizes the liquid flowing through the first inflow path 13 by pressurizing the inside of the first tank 97. The liquid supplied to the droplet discharge head 1 is discharged to the recording medium 93 by driving a first actuator 31 the second actuator 41 in the droplet discharge head 1 (see FIG. 2).

The second tank 98 stores the liquid that is not discharged from the droplet discharge head 1 to the recording medium 93 through an outflow path 15. The second tank 98 also has a second pump 981. The second pump 981 sucks the liquid from the droplet discharge head 1 through the outflow path 15 by depressurizing the inside of the second tank 98. Either one of the first pump 971 and the second pump 981 may be omitted (see FIG. 2).

The outflow path 15 of Embodiment 1 has a cap 982 that comes into contact with the droplet discharge head 1. The second pump 981 depressurizes the inside of the cap 982 via the second tank 98 and sucks the thickened liquid from the droplet discharge head 1. Thereby, the droplet discharge head 1 can suppress accumulation of sediment components in the liquid.

Block Diagram of Droplet Discharge Apparatus

Figure 2:
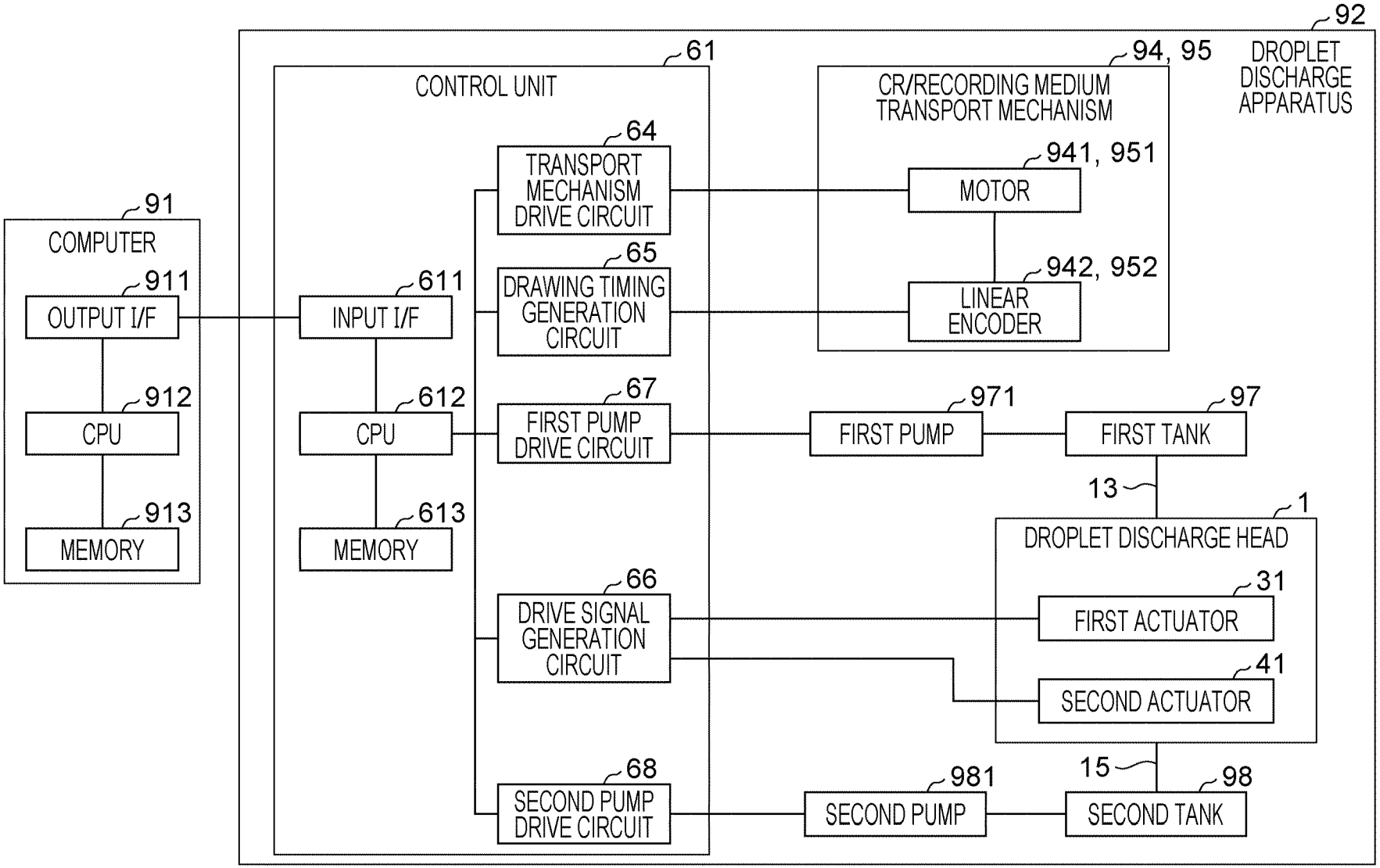
FIG. 2 is a block diagram showing a schematic configuration of the droplet discharge apparatus according to Embodiment 1.

FIG. 2 is a block diagram showing a schematic configuration of the computer 91 and the droplet discharge apparatus 92. First, the configuration of the computer 91 will be briefly described. The computer 91 includes an output interface 911 (output IF), a CPU 912, and a memory 913.

The output IF 911 exchanges data with the droplet discharge apparatus 92. The CPU 912 is an arithmetic processing apparatus for performing overall control of the computer 91. The memory 913 includes a RAM, an EEPROM, a ROM, a magnetic disk apparatus, and the like and stores a computer program used by the CPU 912. The computer program stored in the memory 913 includes an application program. The CPU 912 performs various controls according to the computer program.

The computer outputs drawing data to the droplet discharge apparatus 92. The drawing data is data in a format that can be interpreted by the droplet discharge apparatus and includes various command data and pixel data (SI). The command data is data for instructing the droplet discharge apparatus to execute a specific operation. The command data includes, for example, command data for instructing transport of the recording medium 93 and command data indicating the transport amount. Pixel data (SI) is data relating to a drawing pattern to be drawn.

Here, a pixel is a unit element constituting a drawing pattern. Pixel data (SI) in the drawing data is data (for example, gradation values) related to dots formed on the recording medium 93.

Next, the configuration of the control unit 61 inside the droplet discharge apparatus 92 will be briefly described. The control unit 61 includes an input interface 611 (input IF), a CPU 612, a memory 613, a transport mechanism drive circuit 64, a drawing timing generation circuit 65, a drive signal generation circuit 66, a first pump drive circuit 67, and a second pump drive circuit 68. The input IF 611 exchanges data with the computer 91 which is an external apparatus. The CPU 612 is an arithmetic processing apparatus for performing overall control of the droplet discharge apparatus 92. The memory 613 includes a RAM, an EEPROM, a ROM, a magnetic disk apparatus, and the like and stores a computer program used by the CPU 612. The CPU 612 controls each circuit in accordance with a computer program stored in the memory 613. The drive signal generation circuit 66 will be described later.

The computer program includes a drive signal generation program, a transport mechanism drive program, a drawing timing generation program, a first pump drive program, a second pump drive program, and the like.

The transport mechanism drive circuit 64 controls the transport amount of the carriage moving mechanism 94 and the recording medium transport mechanism 95 via motors 941 and 951 and the like. For example, the carriage 96 is transported in the X direction by rotating the motor 941 of the carriage moving mechanism 94. At this time, a linear encoder 942 attached to the motor 941 calculates the transport amount of the carriage 96 from the rotation amount of the motor 941 and outputs the amount to the drawing timing generation circuit 65. The drawing timing generation circuit 65 generates a clock signal (CK) based on the transport amount and outputs the amount to the drive signal generation circuit 66.

The first pump drive circuit 67 drives the first pump 971 and controls the pressure in the first tank 97. Similarly, the second pump drive circuit 68 drives the second pump 981 to control the pressure in the second tank 98. The second pump 981 depressurizes the inside of the second tank 98 when the droplet discharge head 1 is cleaned and sucks the thickened liquid (ink) from the droplet discharge head 1.

Schematic Configuration of Droplet Discharge Head

Figure 3A:
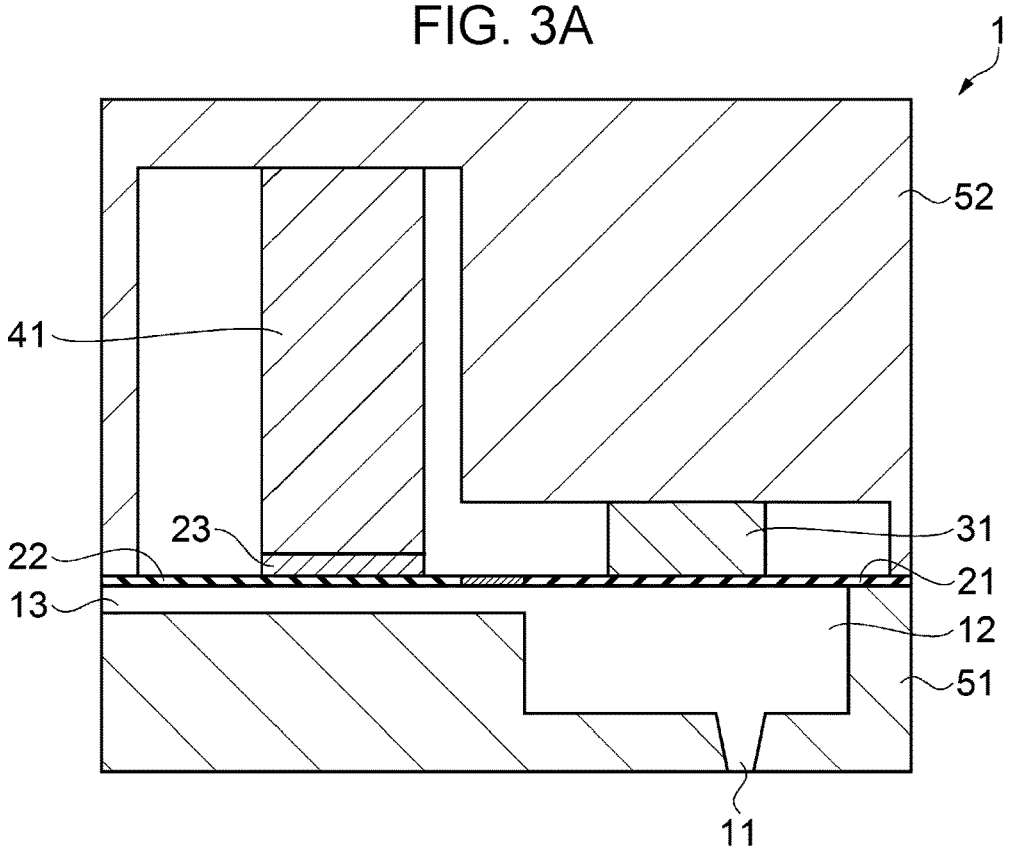
FIG. 3A is a diagram showing an operation of a droplet discharge head according to Embodiment 1.

FIG. 3A is a diagram showing a schematic configuration of the droplet discharge head 1 according to Embodiment 1. The droplet discharge head 1 includes a flow path forming substrate 51, a first vibration plate 21, a second vibration plate 22, an island portion 23, a first actuator 31, and a second actuator 41. In the flow path forming substrate 51, a nozzle 11, a first liquid chamber 12, and the first inflow path 13 are formed.

The first liquid chamber 12 is a space formed by forming a recess in the flow path forming substrate 51 and sealing the opening of the recess with the first vibration plate 21. The first liquid chamber 12 communicates with the first inflow path 13 for supplying the liquid to the first liquid chamber 12 and the nozzle 11 for discharging the liquid to the outside.

The first vibration plate 21 is fixed to the flow path forming substrate 51 and constitutes a part of the wall surface of the first liquid chamber 12. The first vibration plate 21 is a plate-like member (diaphragm) that is configured to be bent and deformed in a first direction and a second direction opposite to the first direction. Here, the first direction refers to a direction in which the first vibration plate 21 is displaced so as to reduce the volume of the first liquid chamber 12, and the second direction refers to a direction in which the first vibration plate 21 is displaced so as to increase the volume of the first liquid chamber 12.

The first actuator 31 is disposed on the first vibration plate 21 and is mechanically coupled to the first vibration plate. The first actuator 31 is fixed to a lid member 52. Since the rigidity of the lid member 52 is higher than the rigidity of the first vibration plate 21, the first vibration plate 21 is displaced in the first direction or the second direction as the first actuator 31 expands and contracts, and the pressure in the first liquid chamber 12 changes.

The second vibration plate 22 is fixed to the flow path forming substrate 51 and constitutes a part of the wall surface of the first inflow path 13. The second vibration plate 22 is a plate-like member (diaphragm) that is configured to be bent and deformed in a first direction and a second direction opposite to the first direction. The first direction refers to a direction in which the second vibration plate 22 is displaced so as to reduce the volume of the first inflow path 13, and the second direction refers to a direction in which the second vibration plate 22 is displaced so as to increase the volume of the first inflow path 13. In other words, the first direction is a direction in which the pressure in the first liquid chamber 12 is increased, and the second direction is a direction in which the pressure in the first liquid chamber 12 is reduced.

The second actuator 41 is disposed on the second vibration plate 22 and is mechanically coupled to the second vibration plate 22 via the island portion 23. The second actuator 41 is fixed to the lid member 52. Since the rigidity of the lid member 52 is higher than the rigidity of the second vibration plate 22, the second vibration plate 22 is displaced in the first direction or the second direction as the second actuator 41 expands and contracts, and the pressure in the first liquid chamber 12 changes. In Embodiment 1, the droplet discharge head 1 includes the second actuator 41 having a larger expansion/contraction amount than the expansion/contraction amount of the first actuator 31. The island portion 23 may be integrally formed with the second vibration plate 22.

In Embodiment 1, the first actuator 31 and the second actuator 41 are configured by piezoelectric elements that expand and contract in accordance with an applied voltage. Each of the first vibration plate 21, the first actuator 31, the lid member 52, and the second vibration plate 22, the second actuator 41, and the lid member 52 may be fixed via islands or electrodes.

Description of Drive Signal Generation Circuit 66

Figure 4:
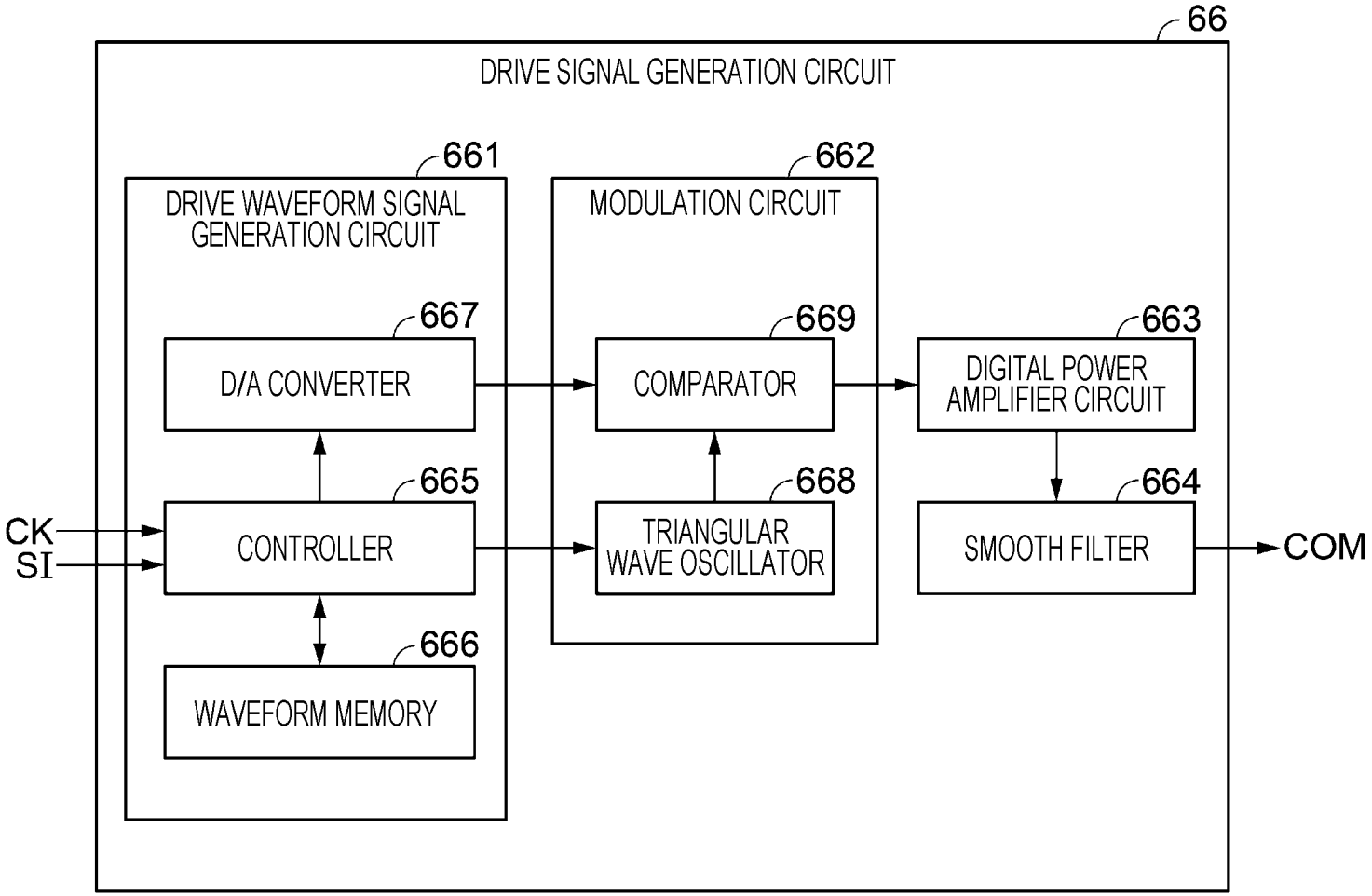
FIG. 4 is a block diagram showing a schematic configuration of a drive vibration generation circuit according to Embodiment 1.

FIG. 4 is a block diagram showing a schematic diagram of the drive signal generation circuit 66. The drive signal generation circuit 66 includes a drive waveform signal generation circuit 661, a modulation circuit 662, a digital power amplification circuit 663, and a smoothing filter 664.

The drive waveform signal generation circuit 661 includes a controller 665, a waveform memory 666, and a D/A converter 667. When a clock signal (CK) and pixel data (SI) are input, the controller 665 reads drive waveform data from the waveform memory 666 based on the pixel data (SI). The waveform memory 666 stores drive waveform data of a drive waveform signal composed of digital potential data and the like. The controller 665 converts the drive waveform data read from the waveform memory 666 into a voltage signal, holds the signal for a predetermined sampling period, and outputs the signal to the D/A converter 667. The controller 665 further instructs the frequency and waveform of the triangular wave signal or the waveform output timing to a triangular wave oscillator 668 to be described later. The D/A converter 667 converts the voltage signal into an analog signal and outputs the signal as a drive waveform signal to a comparator 669 described later.

The modulation circuit 662 includes the triangular wave oscillator 668 and the comparator 669. As the modulation circuit 662, a known pulse width modulation (PWM) circuit is used. The triangular wave oscillator 668 outputs a triangular wave signal serving as a reference signal to the comparator 669 according to the frequency, waveform, and waveform output timing instructed from the controller 665. The comparator 669 compares the driving waveform signal output from the D/A converter 667 with the triangular wave signal output from the triangular wave oscillator 668 and outputs a pulse duty modulation signal, which is on-duty when the drive waveform signal is larger than the triangular wave signal, to a digital power amplification circuit. The frequency of the triangular wave signal (reference signal) is defined as a modulation frequency (generally called a carrier frequency). In addition to the modulation circuit 662, a known pulse modulation circuit such as a pulse density modulation (PDM) circuit can be used.

When the input modulation signal is at a high level, the digital power amplification circuit 663 outputs a supply voltage VDD to the smoothing filter 664 and does not output the supply voltage to the smoothing filter 664 when the input modulation signal is at a low level.

The smoothing filter 664 attenuates and removes the modulation frequency generated by the modulation circuit 662, that is, the frequency component of pulse modulation, and outputs the drive signal to the first actuator 31 and the second actuator 41. Although FIG. 4 is shown as a circuit for easy understanding, the drive waveform signal generation circuit 661 and the modulation circuit 662 are constructed by programming performed in the control unit 61 of FIG. 2.

Droplet Discharge Control

Figure 5:
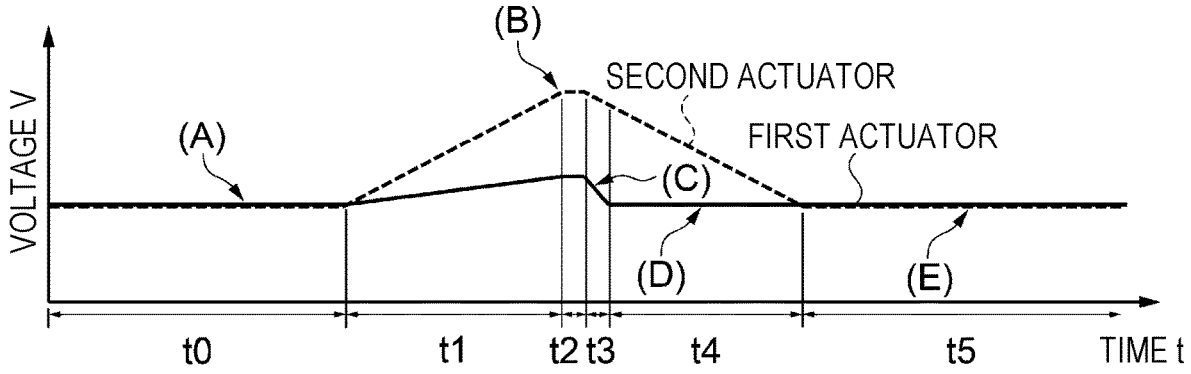
FIG. 5 is a timing chart of droplet discharge control according to Embodiment 1.

Next, a discharge control method will be described. FIG. 5 is an example of a timing chart (solid line) of the first actuator 31 that is executed based on the drive signal input from the drive signal generation circuit 66 and a timing chart (broken line) of the second actuator 41 executed based on the drive signal input from the drive signal generation circuit 66. The horizontal axis in FIG. 5 indicates the elapsed time, and the vertical axis indicates the voltage applied to the first actuator 31 and the second actuator 41. When a positive voltage is applied to the actuator, the first actuator 31 and the second actuator 41 contract and displace the first vibration plate 21 and the second vibration plate 22 in the second direction. This timing chart represents a series of droplet discharge control for discharging the liquid from the nozzle 11 as droplets.

FIGS. 3A to 3E are diagrams showing the operation of the droplet discharge head 1 associated with the droplet discharge control, and FIGS. 6A to 6E are cross-sectional diagrams showing the change of the meniscus over time in the nozzle 11 associated with the droplet discharge control. The cross section is a plane including the center axis C of the nozzle 11. The alphabets (A to E) in FIGS. 3A to 3E and 6A to 6E correspond to the alphabets (A to E) described in FIG. 5.

As shown in FIG. 5, the droplet discharge head 1 executes six processes of each period t0 to t5 in a series of discharge control. The period t0 is an initial state standby process in which an intermediate potential is applied to the first actuator 31 and the second actuator 41. The period t1 is a drawing process in which the first actuator 31 displaces the first vibration plate 21 and the second actuator 41 displaces the second vibration plate 22 in the second direction, respectively, and draws the meniscus in the nozzle 11 toward the first liquid chamber 12. The period t2 is a standby process in which the expansion and contraction amounts of the first actuator 31 and the second actuator 41 are maintained. The period t3 is a liquid column forming process in which the first actuator 31 displaces the first vibration plate 21 in the first direction, reverses the meniscus in the nozzle 11, and forms a liquid column. The period t4 is a pushing process for displacing the second vibration plate 22 in the first direction until the second actuator 41 reaches the intermediate potential. In the period t3 or the period t4, the liquid column is separated from the liquid in the nozzle 11 and discharged as droplets. The period t5 is a refilling process in which the expansion and contraction amounts of the first actuator 31 and the second actuator 41 are maintained and the liquid is supplied from the first inflow path 13 to the nozzle 11 via the first liquid chamber 12.

Figure 6A:
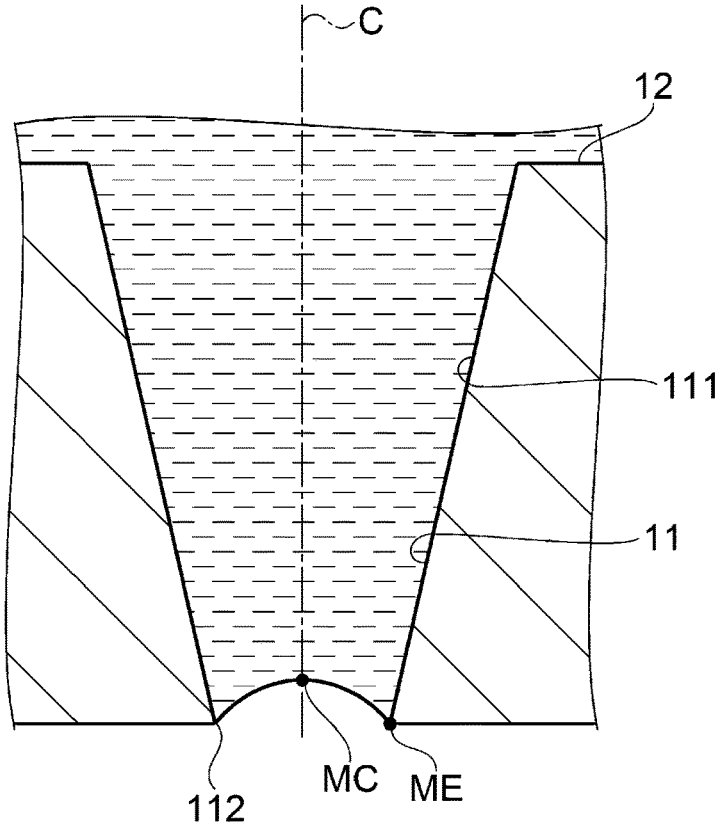
FIG. 6A is a cross-sectional diagram showing a change of a meniscus over time in the nozzle according to Embodiment 1.

In the initial state standby process in the period t0, the liquid in the nozzle 11 before the discharge control is started is maintained at a meniscus pressure resistance or lower. At this time, as shown in FIG. 6A, a boundary ME between a nozzle wall surface 111 and the meniscus is located in an opening 112 of the nozzle 11, and a meniscus MC of the center axis C of the nozzle 11 is located on the first liquid chamber 12 side in the nozzle 11 due to surface tension. This state is defined as a stable state.

Figure 3B:
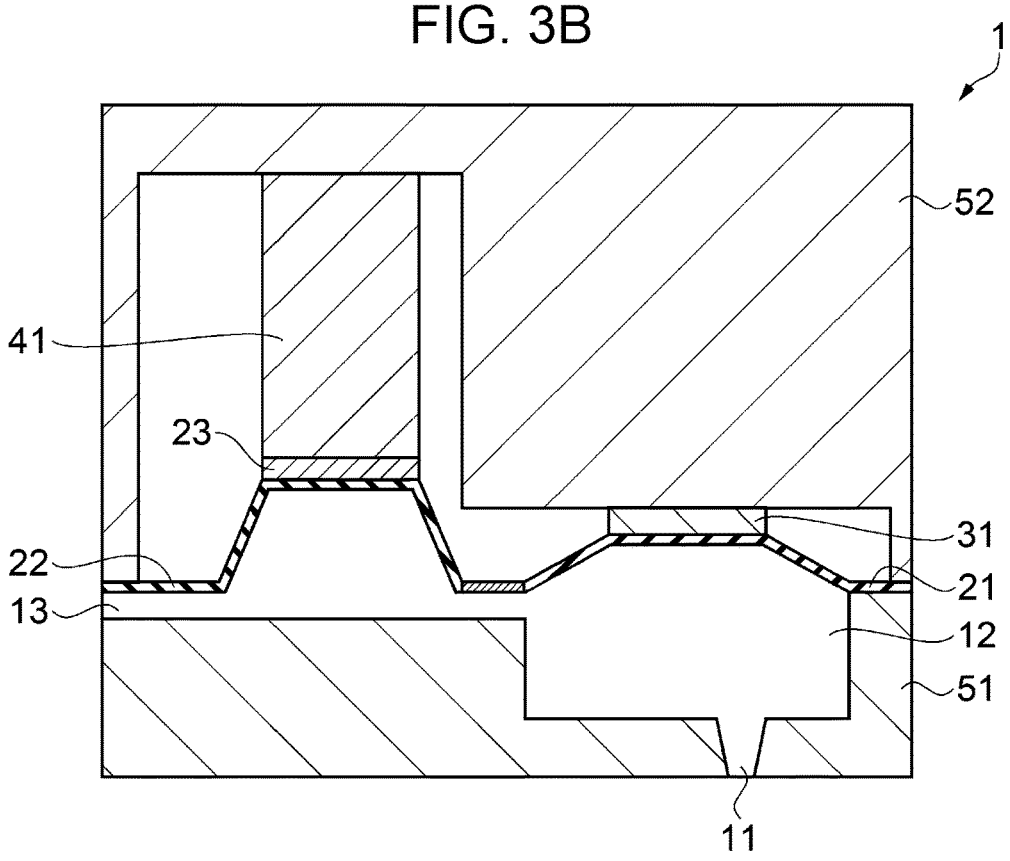
FIG. 3B is a diagram showing the operation of the droplet discharge head according to Embodiment 1.
Figure 6B:
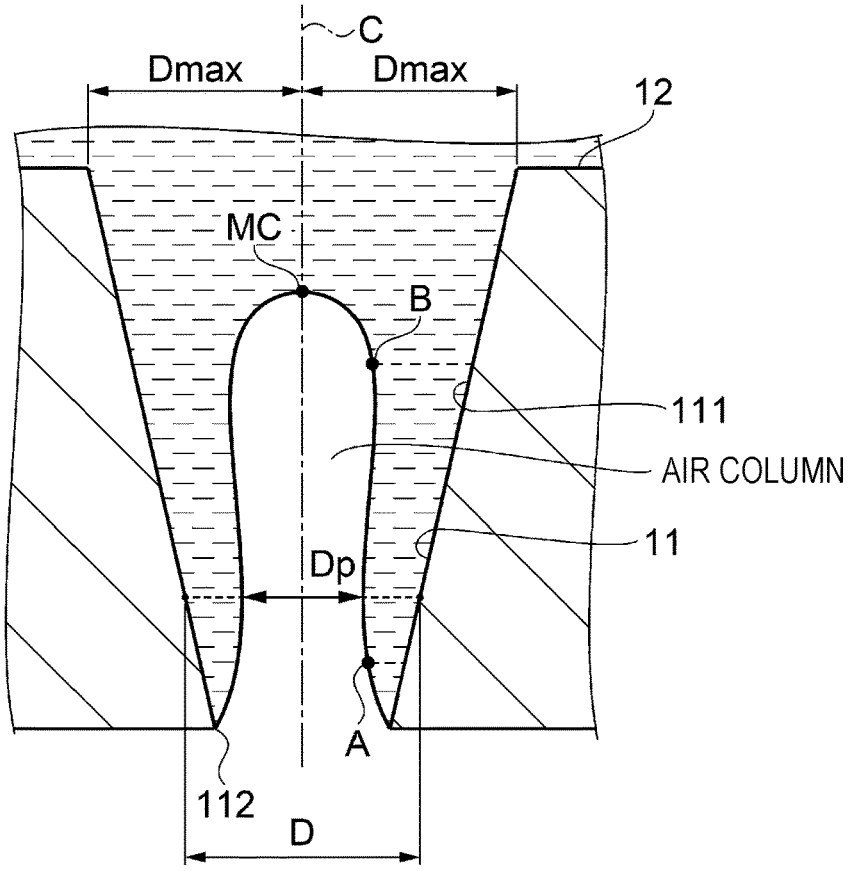
FIG. 6B is a cross-sectional diagram showing the change of the meniscus over time in the nozzle according to Embodiment 1.

In the drawing process in the period t1, when the first actuator 31 contracts, the first vibration plate 21 is displaced in the second direction, and when the second actuator 41 contracts, the second vibration plate 22 is displaced in the second direction (FIG. 3B). Thereby, the volume of the first liquid chamber 12 and the first inflow path 13 expands, and the pressure in the first liquid chamber 12 falls. In this drawing step, the liquid at the center of the nozzle 11 is drawn to the first liquid chamber 12 side, and the liquid on the nozzle wall surface 111 remains in place with a predetermined thickness. This is due to the fact that a large frictional force acts in the region near the boundary surface between the solid and the liquid (the boundary between the nozzle wall surface 111 and the liquid), and the flow rate decreases due to the influence of viscosity. The influence of the interface on the liquid increases as the viscosity of the liquid increases. Therefore, when the first liquid chamber 12 is depressurized and the flow rate toward the first liquid chamber 12 is generated in the liquid in the nozzle 11, the liquid stays on the nozzle wall surface 111, and the liquid at the center of the nozzle 11 having a small influence of the boundary surface is drawn to form a pseudo nozzle that is slightly smaller than the diameter of the nozzle 11 (FIG. 6B). Here, the diameter of the nozzle 11 indicates a distance between the nozzle wall surfaces 111 facing each other via the nozzle 11 center axis C on a plane having the nozzle 11 center axis C as a normal line.

As shown in FIG. 6B, a thickness tm of the liquid remaining on the nozzle wall surface 111 is an average thickness obtained by the following method. First, the state of the liquid in the nozzle 11 is imaged by a stroboscope from the side of the nozzle 11, and in the obtained two-dimensional image, a portion of the curve that satisfies any of the following conditions (i) to (iii) is obtained from the curves represented by the meniscus. (i) The center of curvature of the meniscus is located on the nozzle wall surface 111 side with respect to the meniscus. (ii) The radius of curvature of the meniscus is infinite. The infinite radius of curvature of the meniscus means that the radius of curvature of the meniscus is two or more orders of magnitude larger than the diameter of the opening 112 of the nozzle 11. (iii) The center of curvature of the meniscus is located on the center axis C side of the nozzle 11 with respect to the meniscus, and the radius of curvature of the meniscus is larger than a maximum radius Dmax of the nozzle 11. The end portion on the opening 112 side of the nozzle 11 in the portion of the curve thus obtained is set as a point A, and the end portion on the first liquid chamber 12 side is set as a point B. The average of the distance between the meniscus of the curve between the points A and B on the surface having the center axis C of the nozzle 11 as a normal line and the nozzle wall surface 111 is defined as the liquid thickness tm. When the meniscus is seen from the opening 112 side of the nozzle 11, the diameter of the pseudo nozzle is defined by a diameter Dp that minimizes the distance between the meniscuses facing each other via the nozzle 11 center axis C on the surface having the center axis C of the nozzle 11 as a normal line in the curve between the points A and B. This diameter Dp is taken as the diameter of the pseudo nozzle. The diameter Dp is less than two-thirds of the opening of the nozzle 11. Furthermore, the diameter Dp is preferably less than two-thirds of the diameter of the nozzle 11 on a plane normal to the center axis C of the nozzle 11 including the diameter Dp and is more preferably one-fourth or more and less than two-thirds of the diameter of the nozzle 11.

In the standby process in the period t2, since the applied voltages of the first actuator 31 and the second actuator 41 are kept constant, the positions of the first vibration plate 21 and the second vibration plate 22 are kept. During this time, the pressure wave generated by driving the first actuator 31 and the second actuator 41 during the period t1 reciprocates at a natural frequency Tc of the first liquid chamber 12.

Figure 3C:
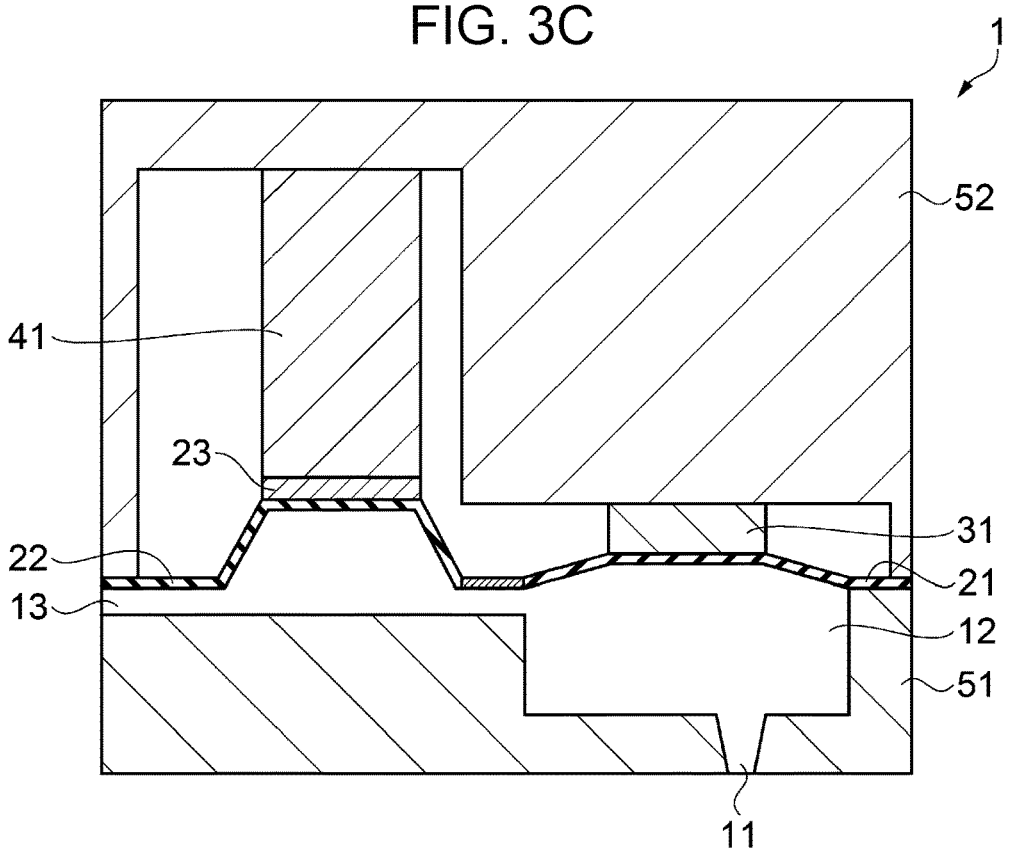
FIG. 3C is a diagram showing the operation of the droplet discharge head according to Embodiment 1.
Figure 6C:
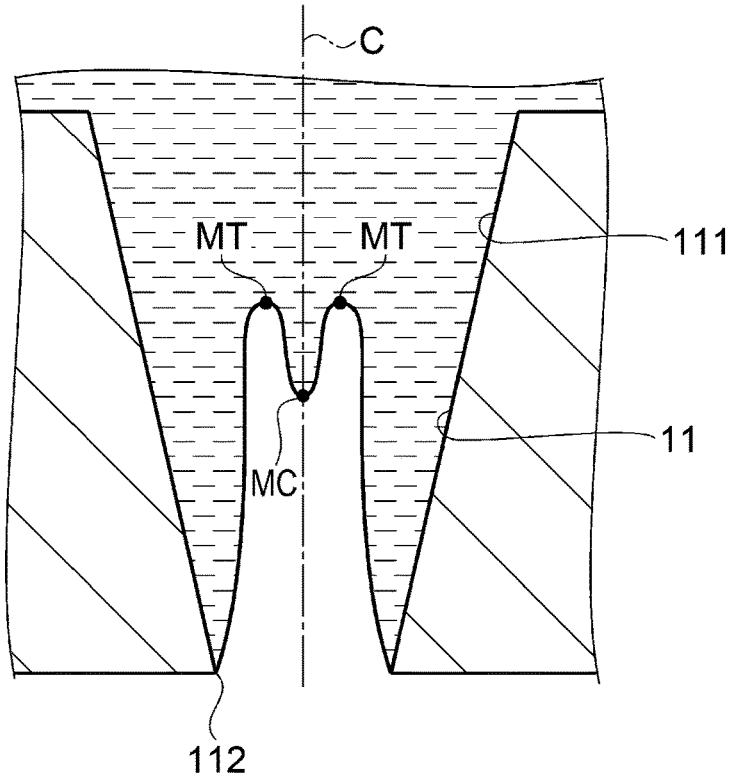
FIG. 6C is a cross-sectional diagram showing the change of the meniscus over time in the nozzle according to Embodiment 1.

In the liquid column forming process in the period t3, the first actuator 31 is extended, whereby the first vibration plate 21 is displaced in the first direction (FIG. 3C). Due to the rapid extension of the first actuator 31, a large amount of energy is instantaneously applied to the liquid in the first liquid chamber 12 to generate a pressure wave. Since this pressure wave propagates from the first liquid chamber 12 to the liquid in the nozzle 11, the meniscus MC of the center axis C of the nozzle 11 is reversed to the opening 112 side of the nozzle 11 to form a liquid column (FIG. 6C). At this time, the second actuator 41 may displace the second vibration plate 22 in the first direction. Here, the liquid column refers to a range from a vertex MC of the inverted meniscus to an extreme value MT where the meniscus protrudes toward the first liquid chamber 12. At this time, it is preferable that the pressure wave generated in the period t3 and the pressure wave generated in the period t2 interfere with each other in the same phase. Thereby, a larger pressure can be applied to the liquid in the nozzle 11.

Figure 3D:
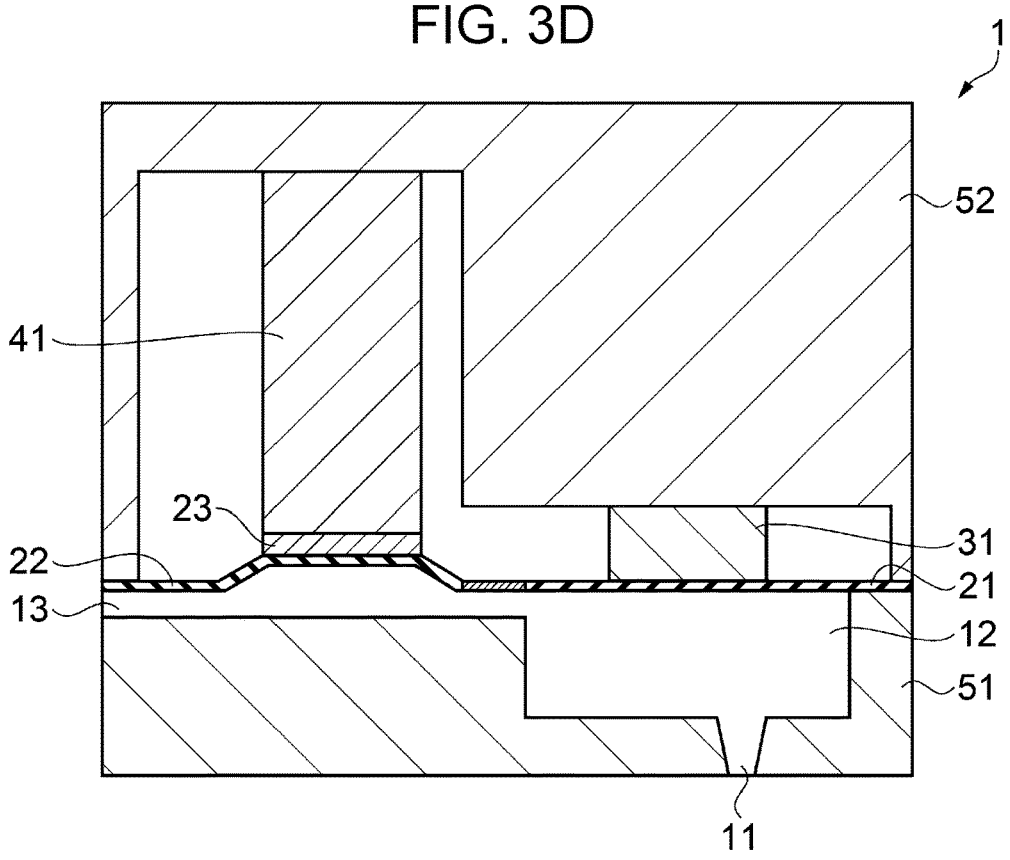
FIG. 3D is a diagram showing the operation of the droplet discharge head according to Embodiment 1.
Figure 3E:
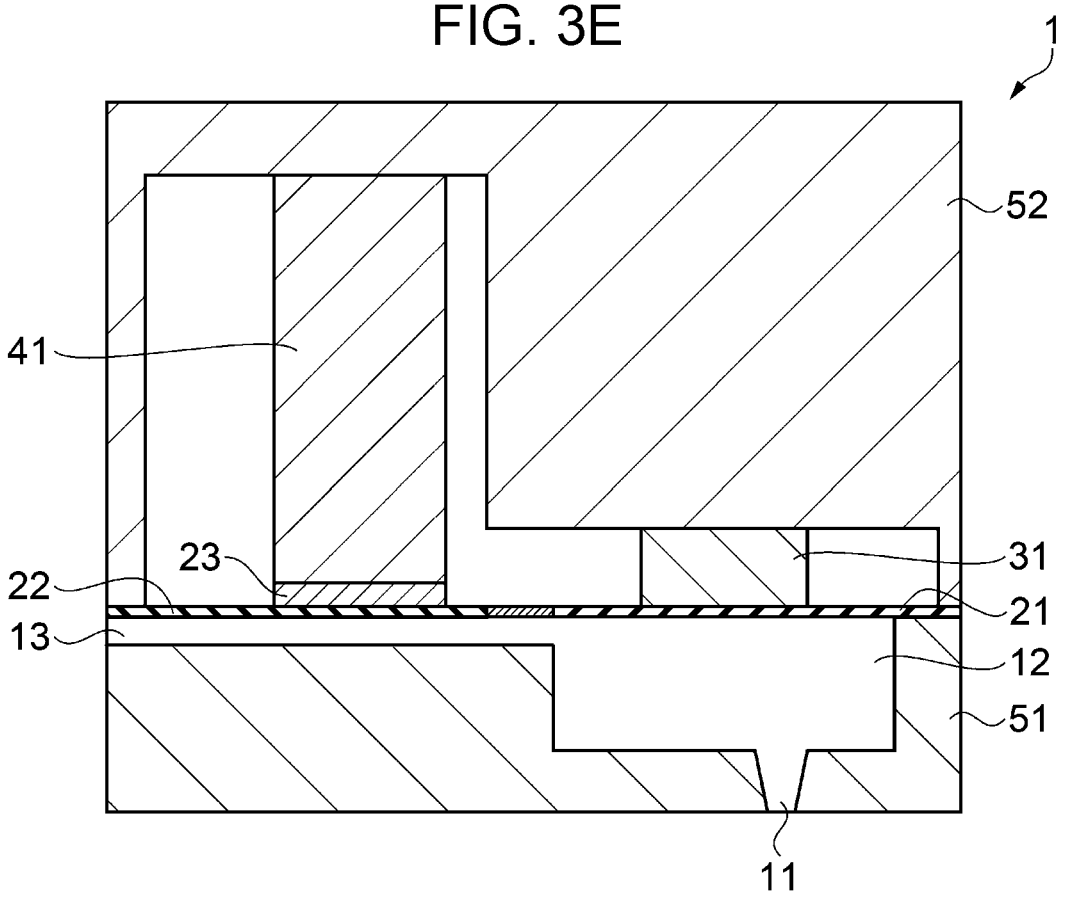
FIG. 3E is a diagram showing the operation of the droplet discharge head according to Embodiment 1.

In the pushing process in the period t4, the first vibration plate 21 is displaced in the first direction by the second actuator 41 extending until the second actuator 41 reaches a predetermined potential (intermediate potential) (FIG. 3D). In Embodiment 1, the first actuator 31 reaches the intermediate potential in the period t3.

Figure 6D:
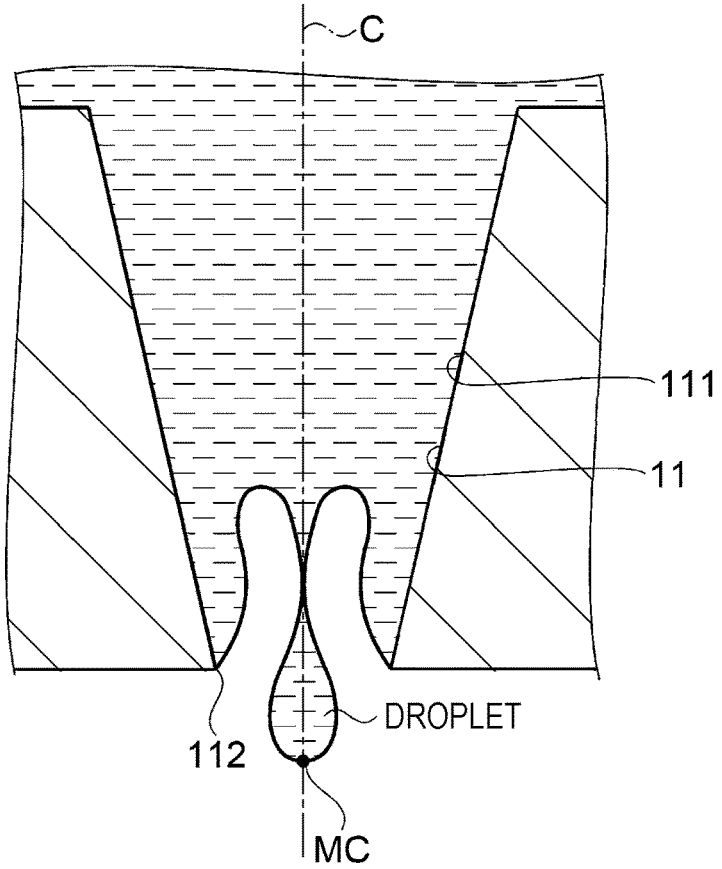
FIG. 6D is a cross-sectional diagram showing the change of the meniscus over time in the nozzle according to Embodiment 1.
Figure 6E:
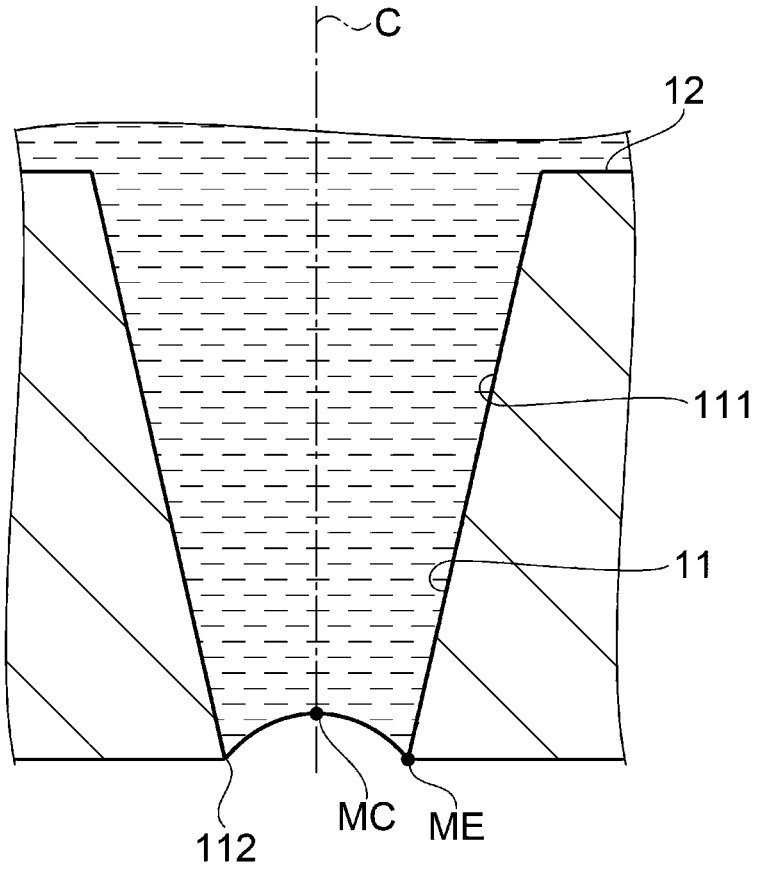
FIG. 6E is a cross-sectional diagram showing the change of the meniscus over time in the nozzle according to Embodiment 1.

In at least one of the period t3 and the period t4, the liquid in the nozzle 11 is pressurized by the displacement of the first vibration plate 21 in the first direction. The pressurized liquid in the nozzle 11 concentrates on the liquid column and selectively pressurizes only the liquid column. This is because a pseudo-nozzle is formed at the center of the nozzle 11, and the channel resistance at the center of the nozzle 11 is smaller than the channel resistance of the nozzle wall surface 111. Thereby, the speed at which the liquid column moves in the direction toward the opening 112 of the nozzle 11 is higher than the speed at which the extreme value MT of the meniscus moves in the direction toward the opening 112 of the nozzle 11. When the total energy applied to the liquid column exceeds the energy that separates the liquid column from the meniscus, the liquid column is discharged as a droplet from the opening 112 of the nozzle 11 (FIG. 6D). In FIG. 5, the droplets are separated from the liquid in the nozzle 11 by the pressurization of the liquid in the pushing process. When the energy for separating the liquid column from the meniscus is applied from the actuator in the liquid column forming process, the pressurization of the liquid in the pushing process may be for returning the meniscus to the stable state.

In the refilling process in the period t5, the positions of the first vibration plate 21 and the second vibration plate 22 are kept constant. At this time, the meniscus in the nozzle 11 returns to the stable state by supplying the liquid from the first inflow path 13.

Non-Discharge Control

When droplets are not discharged from the nozzle 11, no drive signal is applied to the first actuator 31 and the second actuator 41.

As described above, according to the droplet discharge head 1 according to Embodiment 1, since the second actuator 41 having a larger excluded volume than the first actuator 31 reduces the pressure in the nozzle 11, thereby securing an excluded volume necessary for forming a pseudo nozzle in the nozzle 11 in the drawing process. After the pseudo nozzle is formed, the meniscus in the nozzle 11 can be reversed and the timing for forming the liquid column can be controlled appropriately by maintaining the speed at which the first actuator 31 pressurizes the liquid in the nozzle 11.

In the droplet discharge control of Embodiment 1, The start timing of the retracting process of the first actuator 31 and the start timing of the retracting process of the second actuator 41 are the same timing, but the first actuator 31 is preferably driven by delaying the start timing of the drawing process of the first actuator 31 by a predetermined time Δt compared to the start timing of the drawing process of the second actuator 41. This is because the second actuator 41 is positioned upstream of the first actuator 31 in the liquid flow path. The pressure wave generated by the first actuator 31 propagates to the liquid in the nozzle 11 via the first liquid chamber 12, whereas the pressure wave generated by the second actuator 41 propagates to the liquid in the nozzle 11 via the first inflow path 13 and the first liquid chamber 12. Thereby, the pressure change of the liquid in the nozzle 11 can be appropriately controlled. The first vibration plate 21 and the second vibration plate 22 may be integrally formed.

The present disclosure is not limited to the above-described embodiment, and various modifications and improvements can be added to the above-described embodiment. Modification examples will be described below.

MODIFICATION EXAMPLE 1

Figure 7:
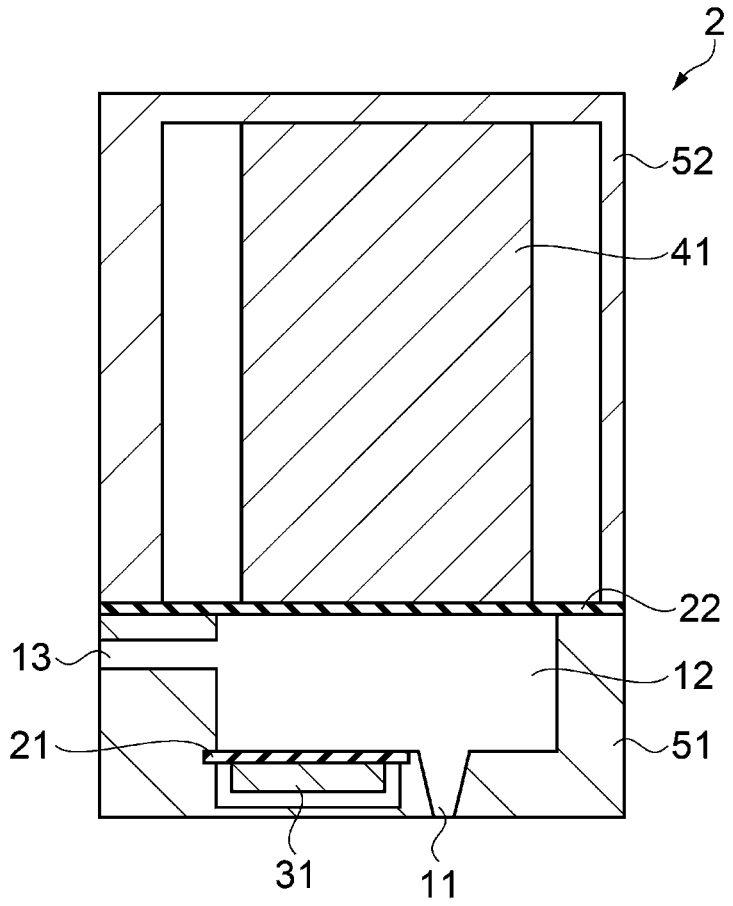
FIG. 7 is a diagram showing a schematic configuration of a droplet discharge head according to Modification Example 1.

In Embodiment 1, as shown in FIG. 3A, it has been described that the second actuator 41 is disposed on the first inflow path 13 via the second vibration plate 22, but the second vibration plate 22 may form a part of the wall surface of the first liquid chamber 12 as in the droplet discharge head 2 shown in FIG. 7. Thereby, the propagation path of the pressure wave generated by the second actuator 41 can be shortened, and the responsiveness of the meniscus to the displacement of the second vibration plate 22 is improved. The first vibration plate 21 and the second vibration plate 22 may be disposed with the first liquid chamber 12 interposed therebetween. Thereby, the volume of the first liquid chamber 12 can be made small, and the responsiveness of the liquid in the nozzle 11 can be improved. The first actuator 31 may be a thin film piezoelectric element as shown in FIG. 7. As a result, a degree of freedom in disposing the first actuator 31 is created. For example, as shown in FIG. 7, when the first liquid chamber 12 is provided on the opening 112 side of the nozzle 11, since the thickness of the first actuator 31 is thin, it is possible to suppress the nozzle 11 from becoming long and the responsiveness of the liquid in the nozzle 11 from falling.

MODIFICATION EXAMPLE 2

Figure 8:
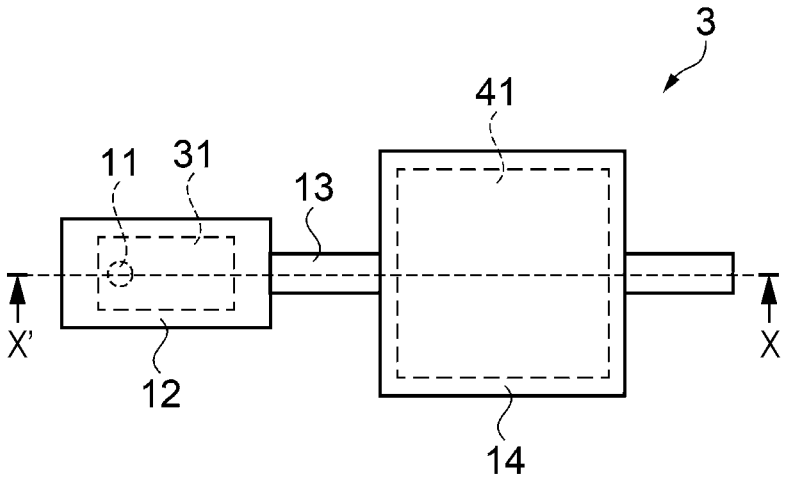
FIG. 8 is a diagram showing a schematic configuration of a droplet discharge head according to Modification Example 2.

In the droplet discharge head 1 of Embodiment 1, as shown in FIG. 3A, it has been described that the second actuator 41 is disposed on the second vibration plate 22 that forms a part of the wall surface of the first inflow path 13., but as in the droplet discharge head 3 shown in FIG. 8, the second liquid chamber 14 may be provided in which the width of the first inflow path 13 is increased by one section. (A cross-sectional diagram of the droplet discharge head of FIG. 8 viewed from an X-X' direction is the same as FIG. 3A.) Here, the width of the first inflow path is the length of the first inflow path in the direction perpendicular to the paper surface of FIG. 3A and can be said to be a direction parallel to the second vibration plate in a plane perpendicular to the liquid flow line. The area where the second vibration plate 22 forms the wall surface of the second liquid chamber 14 is larger than the area where the first vibration plate 21 forms the wall surface of the first liquid chamber 12. Thereby, the excluded volume of the second liquid chamber 14 generated by the second actuator 41 can be increased.

MODIFICATION EXAMPLE 3

Figure 9:
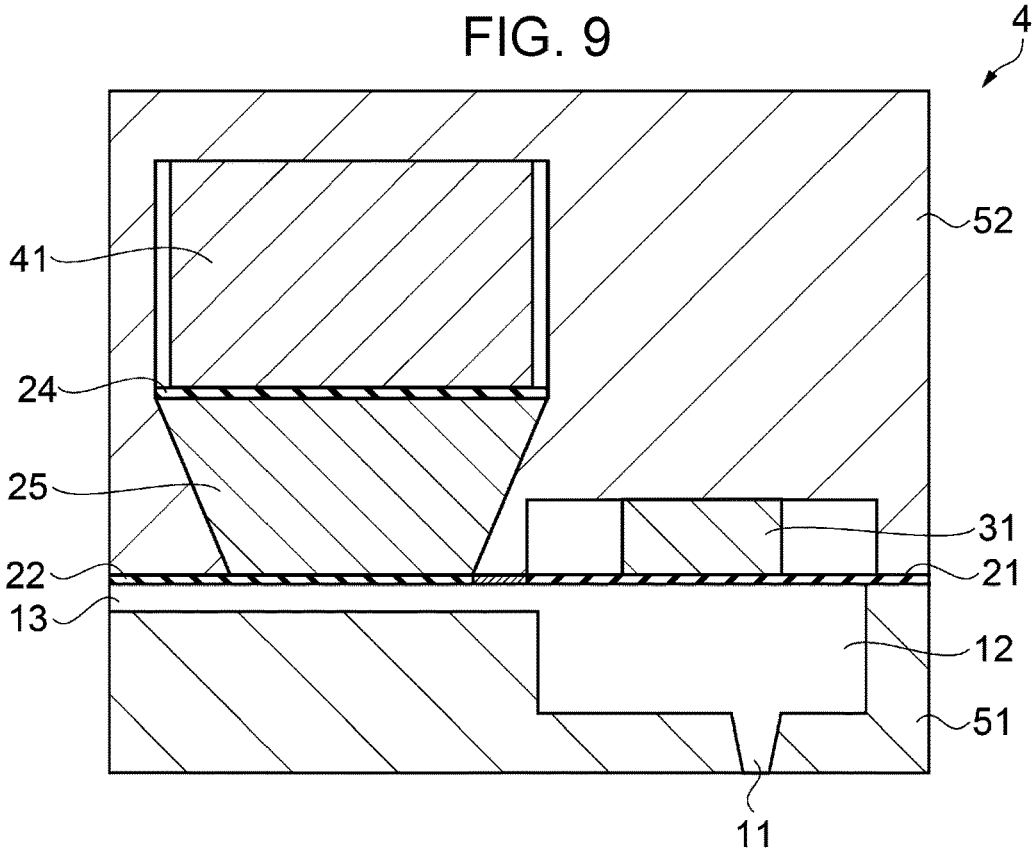
FIG. 9 is a diagram showing a schematic configuration of a droplet discharge head according to Modification Example 3.

In the droplet discharge head 1 of Embodiment 1, as shown in FIG. 3A, it has been described that the second actuator 41 is disposed on the second vibration plate 22 that forms a part of the wall surface of the first inflow path 13, but a displacement amplifying mechanism may be provided between the second actuator 41 and the second vibration plate 22 as in a droplet discharge head 4 shown in FIG. 9. The displacement amplifying mechanism includes a second vibration plate 22, a third vibration plate 24, and a storage chamber 25. The second vibration plate 22 can be flexibly deformed because the surface opposite to the surface forming part of the wall surface of the first inflow path 13 forms a part of the wall surface of the storage chamber 25. The storage chamber 25 and the first inflow path 13 are separated by the second vibration plate 22. The third vibration plate 24 is a plate-shaped member (diaphragm) that forms a part of the wall surface of the storage chamber 25 and can be deformed flexibly. The second actuator 41 is disposed on the surface of the third vibration plate 24 opposite to the surface forming the wall surface of the storage chamber 25. The storage chamber 25 is sealed with liquid, sol, gel, elastic body, and the like. The wall area of the storage chamber 25 formed by the third vibration plate 24 is larger than the wall area of the storage chamber 25 formed by the second vibration plate 22. Since the volume change amount of the storage chamber 25 due to the expansion and contraction of the second actuator 41 and the volume change amount by which the second vibration plate 22 is displaced do not change, the displacement amount of the second vibration plate 22 with respect to the expansion/contraction amount of the second actuator 41 can be increased along with the area ratio.

In the droplet discharge head 4 of Modification Example 3, the area where the third vibration plate 24 forms the wall surface of the storage chamber 25 is larger than the area where the first vibration plate 21 forms the wall surface of the first liquid chamber 12. Thereby, the excluded volume of the first inflow path 13 produced by the second actuator 41 can be enlarged.

MODIFICATION EXAMPLE 4

In the droplet discharge head 4 of Modification Example 3 above, the resonance frequency of the first actuator 31 and the resonance frequency of the second actuator 41 are preferably equal. Thereby, the droplet discharge interval can be shortened when continuous discharge is performed while increasing the excluded volume of the first inflow path 13 generated by the second actuator 41.

MODIFICATION EXAMPLE 5

Figure 10:
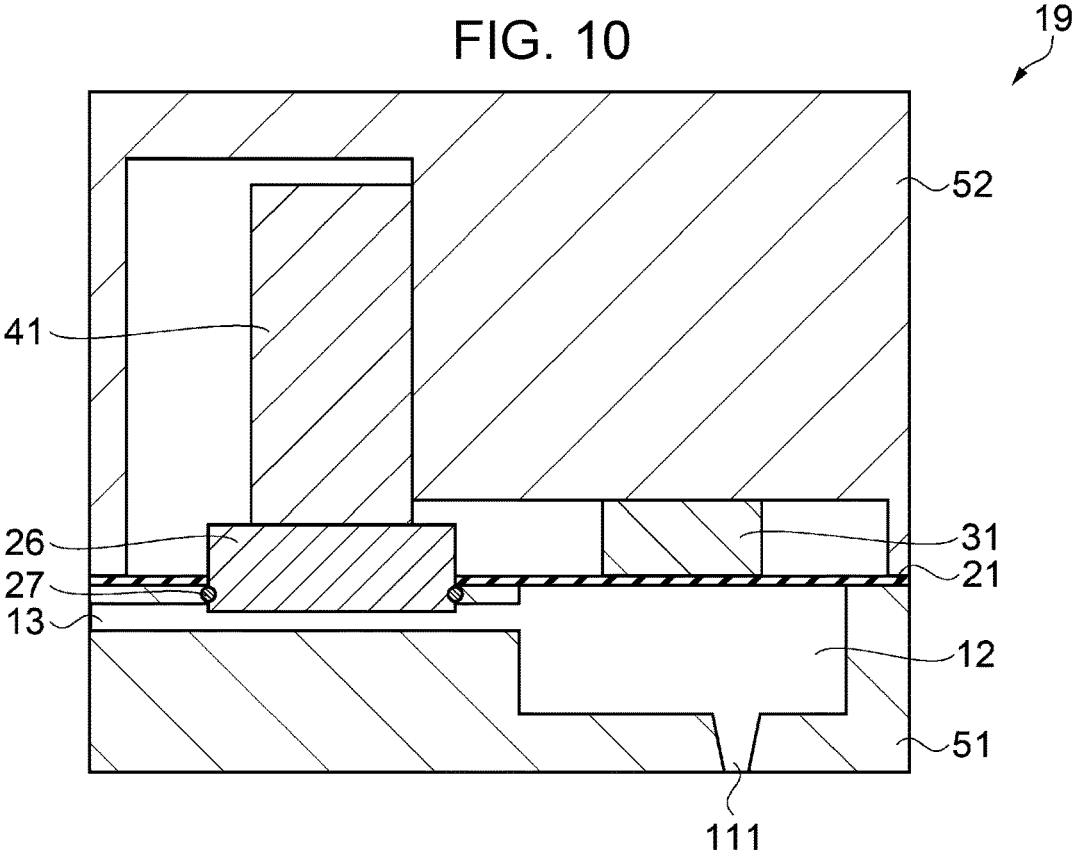
FIG. 10 is a diagram showing a schematic configuration of a droplet discharge head according to Modification Example 5.

In the droplet discharge head 1 of Embodiment 1, as shown in FIG. 3A, the second vibration plate 22 has been described as a plate-like member (diaphragm) that can be bent and deformed, but the second vibration plate 22 may be a piston that can reciprocate like the droplet discharge head 19 shown in FIG. 10. The second vibration plate 26 is mechanically coupled to the second actuator 41, and a sealing member 27 is provided in the gap between the second vibration plate 26 and the flow path forming substrate 51. Thereby, the displacement amount of the second vibration plate 26 can be freely set without increasing the width of the first inflow path 13.

MODIFICATION EXAMPLE 6

Figure 11:
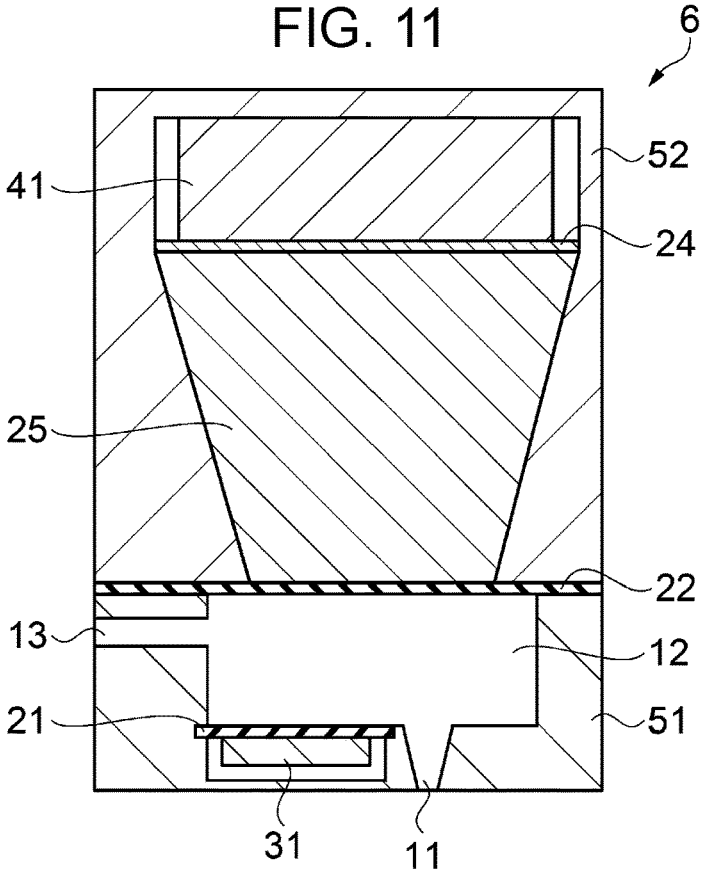
FIG. 11 is a diagram showing a schematic configuration of a droplet discharge head according to Modification Example 6.

In the droplet discharge head 2 of the first modification, as shown in FIG. 7, it has been described that the second actuator 41 is disposed on the second vibration plate 22 that forms a part of the wall surface of the first liquid chamber 12, but a displacement amplifying mechanism may be provided between the second actuator 41 and the second vibration plate 22 as in a droplet discharge head 6 shown in FIG. 11. The displacement amplifying mechanism has the same configuration as that of Modification Example 3 and is omitted. Thereby, the displacement amount of the second vibration plate 22 with respect to the expansion/contraction amount of the second actuator 41 can be increased in accordance with the area ratio.

In the droplet discharge head 6 of Modification Example 6, the area where the third vibration plate 24 forms the wall surface of the storage chamber 25 is larger than the area where the first vibration plate 21 forms the wall surface of the first liquid chamber 12. Thereby, the excluded volume of the first liquid chamber 12 generated by the second actuator 41 can be increased.

MODIFICATION EXAMPLE 7

In the droplet discharge head 6 of Modification Example 6 above, the resonance frequency of the first actuator 31 and the resonance frequency of the second actuator 41 are preferably equal. Thereby, the droplet discharge interval can be shortened when continuous discharge is performed while increasing the excluded volume of the first liquid chamber 12 generated by the second actuator 41.

MODIFICATION EXAMPLE 8

It has been described that the droplet discharge head 1 of Embodiment 1 includes the first inflow path 13 and the nozzle 11, but may further communicate with the outflow path. One opening of the outflow path 15 communicates with the first liquid chamber 12 or the nozzle 11. The other opening of the outflow path 15 communicates with the first tank 97 or the second tank 98. Thereby, it is possible to suppress discharge failure due to thickening of the liquid in the first liquid chamber 12 or the nozzle 11 and discharge failure due to bubbles mixed from the opening 112 of the nozzle 11.

Figure 12:
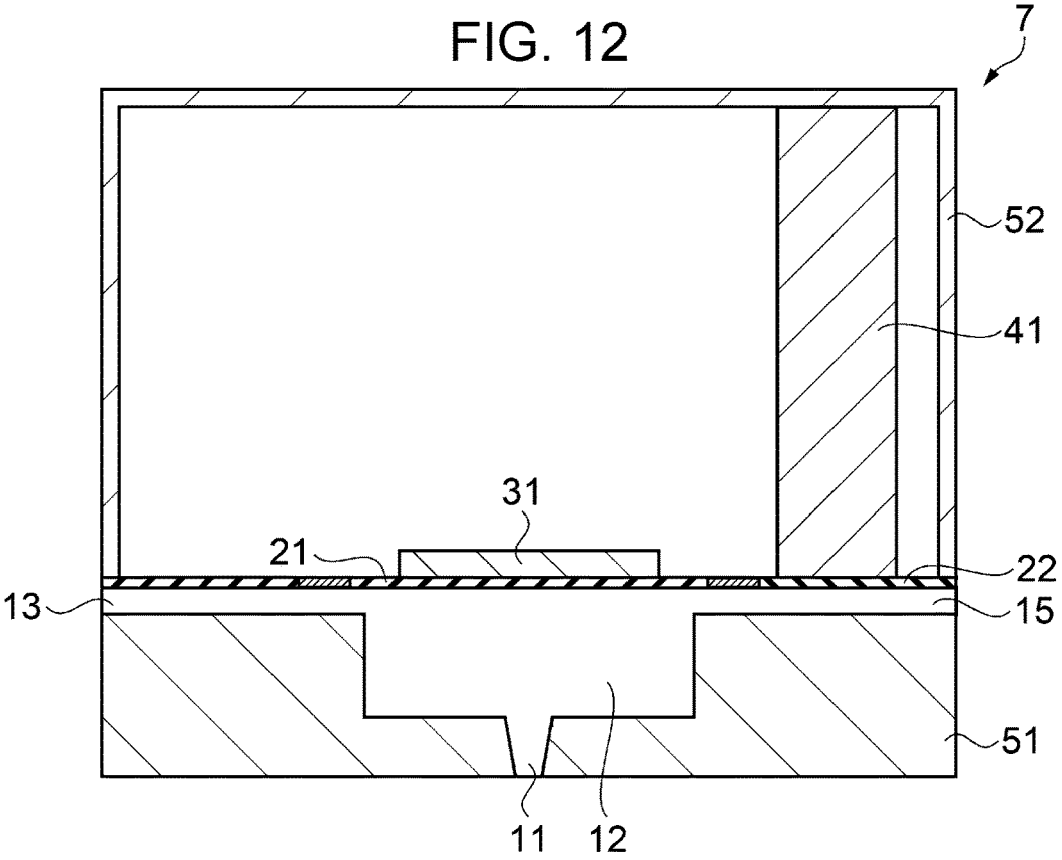
FIG. 12 is a diagram showing a schematic configuration of a droplet discharge head according to Modification Example 8.

In the above Modification Example 8, as in the droplet discharge head 7 shown in FIG. 12, the second vibration plate 22 forms a part of the wall surface of the outflow path 15 instead of the first inflow path 13, and the second actuator 41 may be disposed on the second vibration plate 22. Thereby, in the drawing process, it is possible to easily discharge the thickened liquid, sediment, bubbles, and the like in the first liquid chamber 12 to the discharge path.

MODIFICATION EXAMPLE 9

Figure 13:
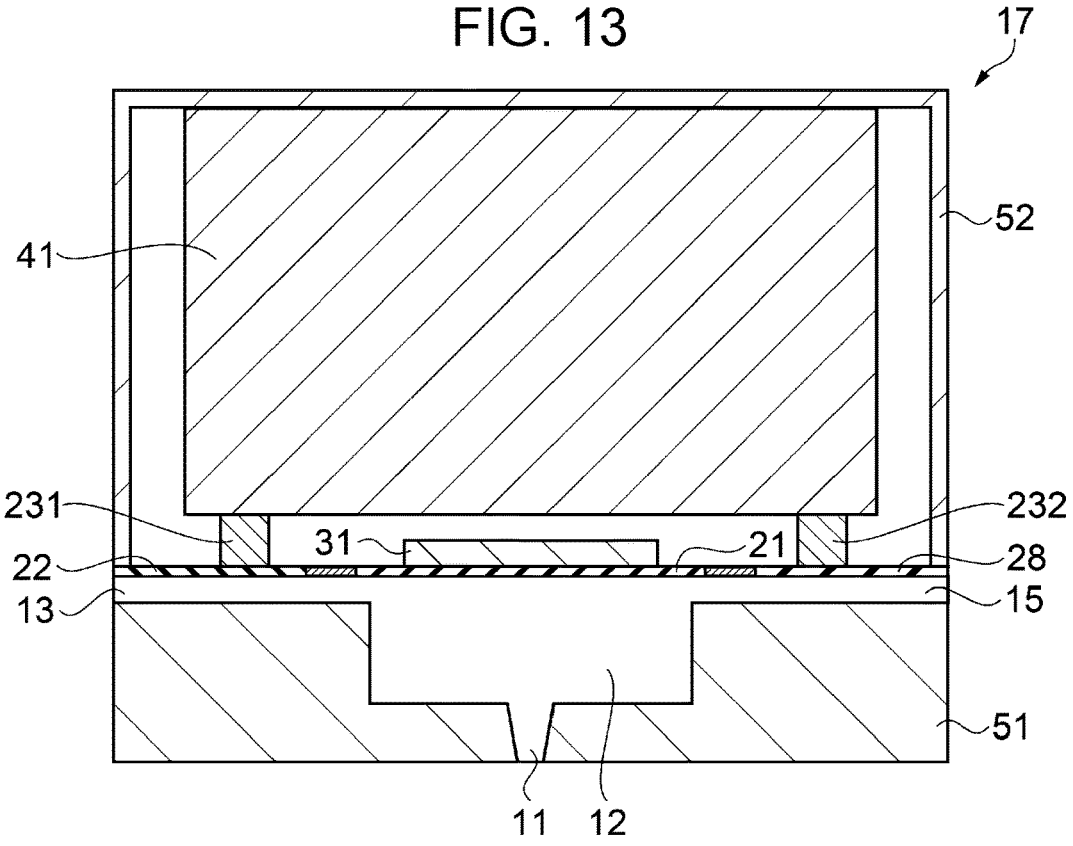
FIG. 13 is a diagram showing a schematic configuration of a droplet discharge head according to Modification 9.

Like the droplet discharge head 17 shown in FIG. 13, the outflow path 15 may be configured to communicate with the first liquid chamber 12, and the second actuator 41 may be configured to change the volumes of the first inflow path 13 and the outflow path 15. The second actuator 41 is coupled to the second vibration plate 22 via an island portion 231 and is coupled to a fourth vibration plate 28 forming a part of the wall surface of the outflow path 15 via the island portion 232. Thereby, the volume change amount of the outflow path 15 and the first inflow path 13 can be increased with respect to the expansion/contraction amount of the second actuator 41. The first vibration plate 21, the second vibration plate 22, and the fourth vibration plate 28 may be integrally formed.

MODIFICATION EXAMPLE 10

Figure 14:
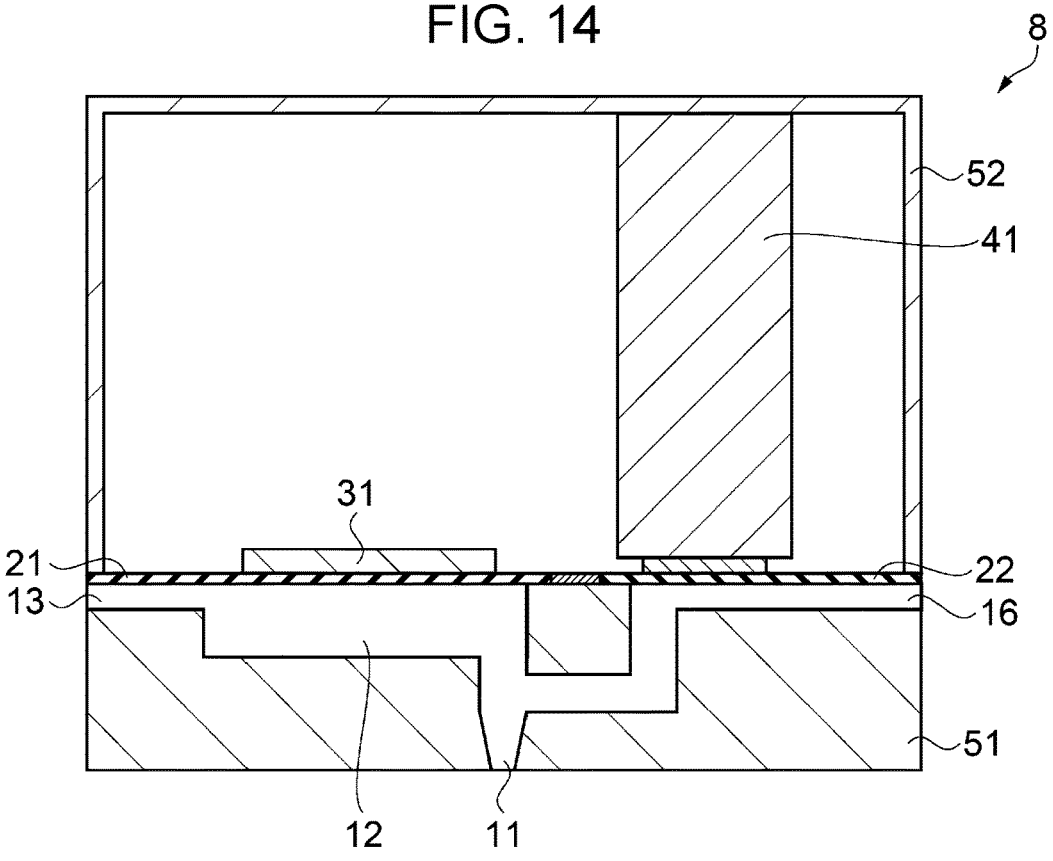
FIG. 14 is a diagram showing a schematic configuration of a droplet discharge head according to Modification Example 10.

In the droplet discharge head 1 of the above Embodiment 1, as shown in FIG. 3A, it has been described that the second actuator 41 is disposed on the second vibration plate 22 that forms a part of the wall surface of the first inflow path 13, but as in the droplet discharge head 8 shown in FIG. 14, the second actuator 41 may be disposed on the second vibration plate 22 that forms a part of the wall surface of the second inflow path 16 that communicates with the nozzle 11. Even in this way, the effect similar to the above can be obtained.

MODIFICATION EXAMPLE 11

Figure 15A:
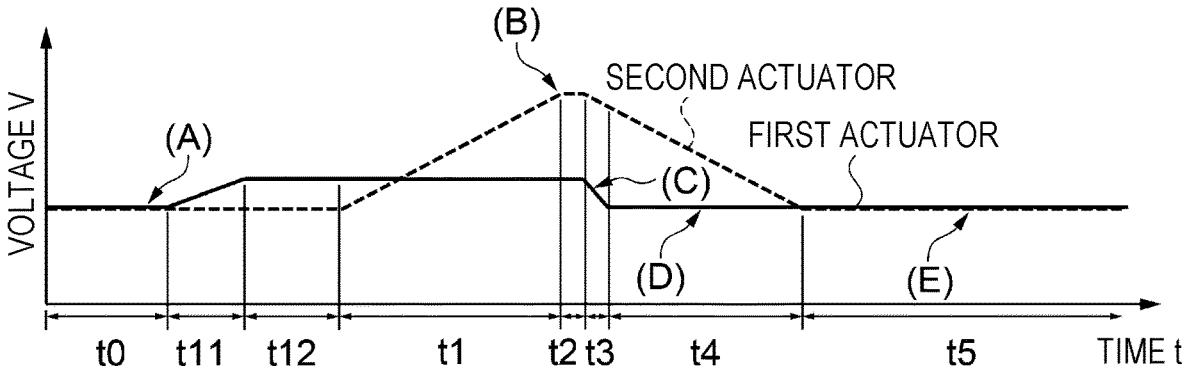
FIG. 15A is a timing chart of droplet discharge control according to Modification Example 11.

In the above embodiment, in the timing chart of droplet discharge control (FIG. 5), the contraction of the first actuator 31 and the second actuator 41 is executed in the period t1, but the first actuator 31 may be contracted prior to the drawing process in the period t1 to displace the first vibration plate 21 in the second direction (period t11 in FIG. 15A). Even in this way, the effect similar to the above can be obtained.

MODIFICATION EXAMPLE 12

Figure 15B:
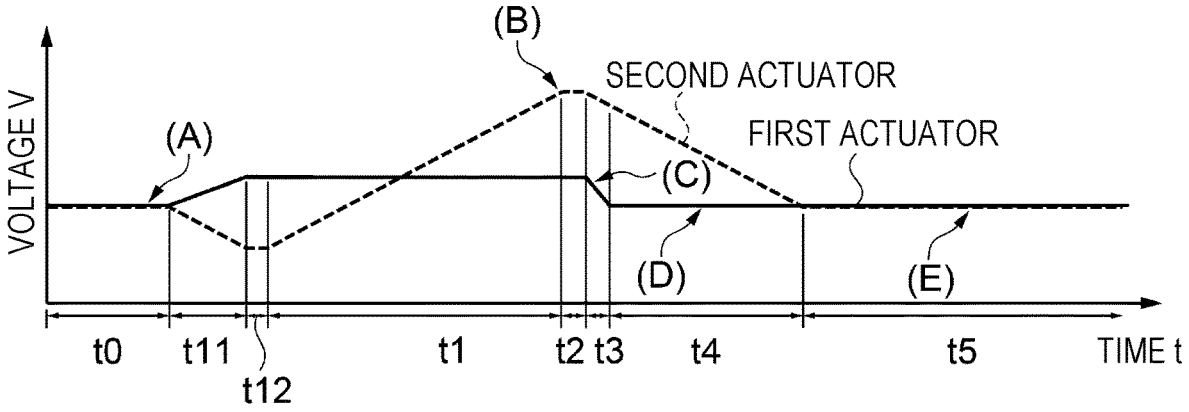
FIG. 15B is a timing chart of droplet discharge control according to Modification Example 12.

In the above modification example, in the droplet discharge control timing chart (FIG. 15A), the drawing process of the first actuator 31 is executed before the drawing process (period t1) of the second actuator 41, but in the drawing process of the first actuator 31 (period t11), the second actuator 41 may be extended to displace the first vibration plate 21 in the first direction (FIG. 15B).

Thereby, the displacement amount of the first vibration plate 21 in the drawing process (period t1) of the second actuator 41 can be increased, and it is easy to draw in the liquid in the nozzle 11 largely. When the first actuator 31 contracts during the period t11, the amount of displacement of the first vibration plate 21 in the first direction can be reduced, and liquid leakage from the nozzle 11 can be suppressed.

MODIFICATION EXAMPLE 13

Figure 15C:
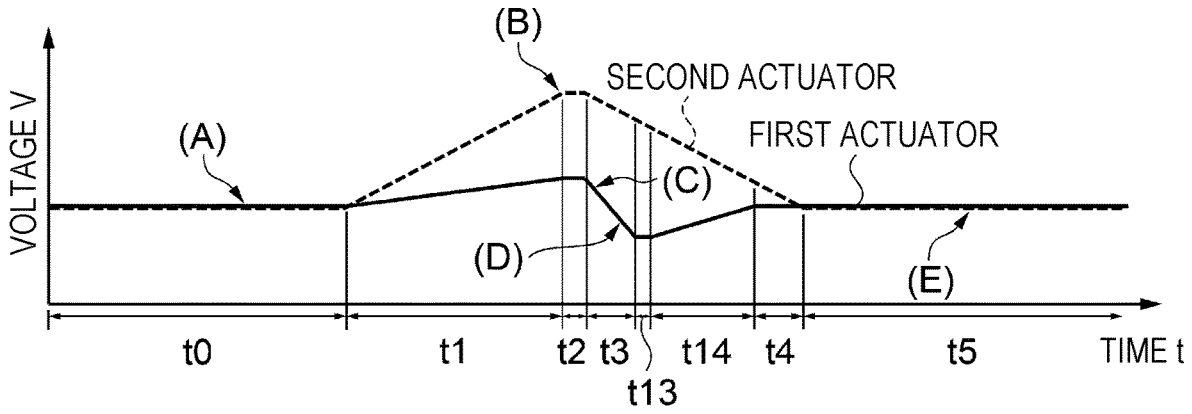
FIG. 15C is a timing chart of droplet discharge control according to Modification Example 13.

In the above embodiment, in the droplet discharge control timing chart (FIG. 5), in the liquid column forming process, the first actuator 31 extends until reaching the intermediate potential but may extend beyond the intermediate potential (FIG. 15C). Thereby, the liquid column formed in the nozzle 11 can be pressurized efficiently.

MODIFICATION EXAMPLE 14

Figure 15D:
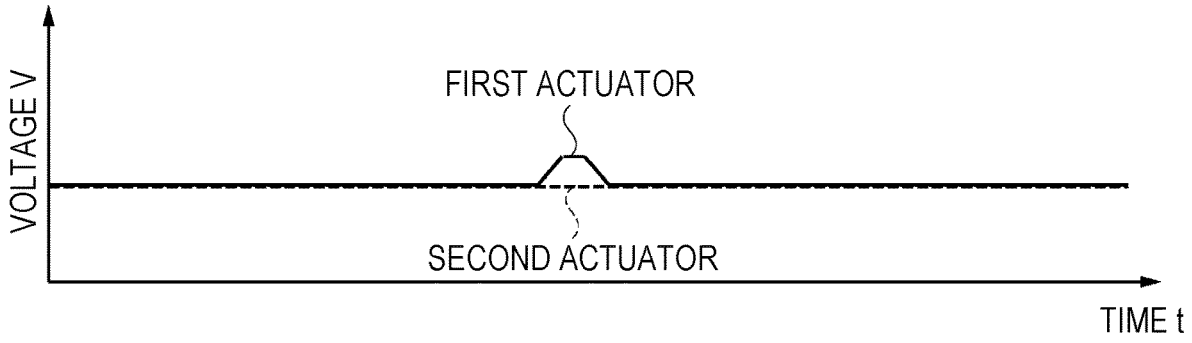
FIG. 15D is a timing chart of droplet discharge control according to Modification Example 14.

In the above embodiment, it has been described that the first actuator 31 and the second actuator 41 are not driven in the non-discharge control, but a fine vibration signal may be applied to the first actuator 31 (FIG. 15D). Thereby, the liquid in the nozzle 11 is agitated, and the discharge failure due to the thickening of the liquid can be prevented.

MODIFICATION EXAMPLE 15

Figure 15E:
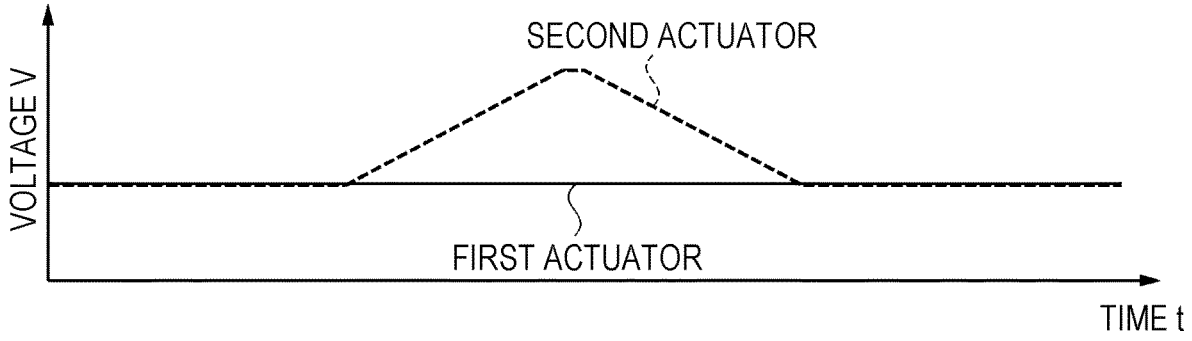
FIG. 15E is a timing chart of droplet discharge control according to Modification Example 15.

In the above-described modified example 14, it has been described that in the non-discharge control, a fine vibration signal is applied to the first actuator 31, but a fine vibration signal may be applied to the second actuator (FIG. 15E). Thereby, compared with the first actuator 31, the liquid in the nozzle 11 can be stirred a lot, and the discharge failure due to the thickening of the liquid can be prevented.

MODIFICATION EXAMPLE 16

The second actuator 41 of the above embodiment may be configured by various elements that generate displacement, such as an air cylinder, a solenoid, and a magnetostrictive element. In this way, the same effect as described above can be obtained.

MODIFICATION EXAMPLE 17

In the droplet discharge head 1 of the above embodiment, when the droplet discharge head 1 continuously discharges droplets (that is, the timing chart of FIG. 5 is repeated), the period t0 and the period t5 in a second and subsequent discharge operations may be omitted. As a result, the droplet discharge interval is shortened, and the drawing speed can be increased.

MODIFICATION EXAMPLE 18

The transport mechanism according to the embodiment has been described as the recording medium transport mechanism 95 and the carriage moving mechanism 94, but the transport mechanism may be a 3D drive stage, and when the droplet discharge head 1 is a line head, the carriage moving mechanism 94 may be omitted.

MODIFICATION EXAMPLE 19

Although the nozzle 11 according to the above-described embodiment has been described as a tapered shape, the nozzle 11 may have a cylindrical shape. In the cylindrical nozzle, the shape of the meniscus drawn into the nozzle in the drawing process can be stabilized. Thereby, repeatability can be improved.

The contents derived from the embodiment will be described below.

The droplet discharge head of the present application is a droplet discharge head mounted on a droplet discharge apparatus including a control unit for controlling droplet discharge, the head including a first liquid chamber formed on a flow path forming substrate, a nozzle communicating with the first liquid chamber, a first inflow path for supplying a liquid to the first liquid chamber, a first vibration plate forming a part of a wall surface of the first liquid chamber, a second vibration plate forming a part of a wall surface of the first inflow path, a first actuator for displacing the first vibration plate to change a pressure in the first liquid chamber, and a second actuator for displacing the second vibration plate to change the pressure in the first liquid chamber, in which an excluded volume of the second actuator is larger than that of the first actuator, and based on a drive signal from the control unit, the second actuator is driven to draw a meniscus in the nozzle by depressurizing the inside of the first liquid chamber, and the first actuator is driven to discharge droplets from the nozzle by pressurizing the first liquid chamber.

According to this configuration, since the second actuator having a larger excluded volume than the first actuator reduces the pressure in the nozzle, thereby securing an excluded volume necessary for forming a pseudo nozzle in the nozzle in the drawing process. After the pseudo nozzle is formed, the meniscus in the nozzle can be reversed and the timing for forming the liquid column can be controlled appropriately by maintaining the speed at which the first actuator pressurizes the liquid in the nozzle.

According to another aspect of the present disclosure, there is provided a droplet discharge head mounted on a droplet discharge apparatus including a control unit for controlling droplet discharge, the head including a first liquid chamber formed on a flow path forming substrate, a nozzle communicating with the first liquid chamber, a first inflow path for supplying a liquid to the first liquid chamber, a first vibration plate forming a part of a wall surface of the first liquid chamber, a second vibration plate forming a part of a wall surface of the first liquid chamber, a first actuator for displacing the first vibration plate to change a pressure in the first liquid chamber, and a second actuator for displacing the second vibration plate to change the pressure in the first liquid chamber, in which an excluded volume of the second actuator is larger than that of the first actuator, and based on a drive signal from the control unit, the second actuator is driven to draw a meniscus in the nozzle by depressurizing the inside of the first liquid chamber, and the first actuator is driven to discharge droplets from the nozzle by pressurizing the first liquid chamber.

According to this configuration, since the second actuator having a larger excluded volume than the first actuator reduces the pressure in the nozzle, thereby securing an excluded volume necessary for forming a pseudo nozzle in the nozzle in the drawing process. After the pseudo nozzle is formed, the meniscus in the nozzle can be reversed and the timing for forming the liquid column can be controlled appropriately by maintaining the speed at which the first actuator pressurizes the liquid in the nozzle.

According to still another aspect of the present disclosure, there is provided a droplet discharge head mounted on a droplet discharge apparatus including a control unit for controlling droplet discharge, the head including a first liquid chamber formed on a flow path forming substrate, a nozzle communicating with the first liquid chamber, a first inflow path for supplying a liquid to the first liquid chamber, an outflow path communicating with the first liquid chamber or the nozzle and discharging the liquid, a first vibration plate forming a part of a wall surface of the first liquid chamber, a second vibration plate forming a part of a wall surface of the outflow path, a first actuator for displacing the first vibration plate to change a pressure in the first liquid chamber, and a second actuator for displacing the second vibration plate to change the pressure in the first liquid chamber, in which an excluded volume of the second actuator is larger than that of the first actuator, and based on a drive signal from the control unit, the second actuator is driven to draw a meniscus in the nozzle by depressurizing the inside of the first liquid chamber, and the first actuator is driven to discharge droplets from the nozzle by pressurizing the first liquid chamber.

According to this configuration, since the second actuator having a larger excluded volume than the first actuator reduces the pressure in the nozzle, thereby securing an excluded volume necessary for forming a pseudo nozzle in the nozzle in the drawing process. After the pseudo nozzle is formed, the meniscus in the nozzle can be reversed and the timing for forming the liquid column can be controlled appropriately by maintaining the speed at which the first actuator pressurizes the liquid in the nozzle.

According to still another aspect of the present disclosure, there is provided a droplet discharge head mounted on a droplet discharge apparatus including a first liquid chamber formed on a flow path forming substrate, a nozzle communicating with the first liquid chamber, a first inflow path for supplying a liquid to the first liquid chamber, a second inflow path for supplying the liquid to the nozzle, a first vibration plate forming a part of a wall surface of the first liquid chamber, a second vibration plate forming a part of a wall surface of the second inflow path, a first actuator for displacing the first vibration plate to change a pressure in the first liquid chamber, and a second actuator for displacing the second vibration plate to change a pressure in the nozzle, in which an excluded volume of the second actuator is larger than that of the first actuator, and based on a drive signal from the control unit, the second actuator is driven to draw a meniscus in the nozzle by depressurizing the inside of the nozzle, and the first actuator is driven to discharge droplets from the nozzle by pressurizing the first liquid chamber.

According to this configuration, since the second actuator having a larger excluded volume than the first actuator reduces the pressure in the nozzle, thereby securing an excluded volume necessary for forming a pseudo nozzle in the nozzle in the drawing process. After the pseudo nozzle is formed, the meniscus in the nozzle can be reversed and the timing for forming the liquid column can be controlled appropriately by maintaining the speed at which the first actuator pressurizes the liquid in the nozzle.

In the droplet discharge head, an expansion/contraction amount of the second actuator may be larger than that of the first actuator.

According to this configuration, the same effect as the above configuration can be obtained.

In the droplet discharge head, the second actuator may displace the second vibration plate via an displacement amplifying mechanism that increases a displacement amount of the second vibration plate with respect to an expansion/contraction amount of the second actuator.

According to this configuration, since the volume change amount of the storage chamber due to the expansion and contraction of the second actuator and the volume change amount by which the second vibration plate is displaced do not change, the displacement amount of the second vibration plate with respect to the expansion/contraction amount of the second actuator can be increased along with the area ratio.

In the droplet discharge head, the second vibration plate may be a diaphragm.

According to this configuration, the same effect as the above configuration can be obtained.

In the droplet discharge head, the second vibration plate may be a piston that reciprocates according to the expansion and contraction of the second actuator.

According to this configuration, the displacement amount of the second vibration plate can be freely set without increasing the width of the first inflow path.

In the droplet discharge head, the area where the second vibration plate forms the wall surface of the first inflow path may be larger than the area where the first vibration plate forms the wall surface of the first liquid chamber.

According to this configuration, the excluded volume of the flow path or the liquid chamber generated by the second actuator can be increased.

In the droplet discharge head, the area where the second vibration plate forms the wall surface of the first liquid chamber may be larger than the area where the first vibration plate forms the wall surface of the first liquid chamber.

According to this configuration, the volume of the first liquid chamber can be reduced, and the responsiveness of the liquid in the nozzle can be improved.

In the droplet discharge head, the area where the second vibration plate forms the wall surface of the outflow path may be larger than the area where the first vibration plate forms the wall surface of the first liquid chamber.

According to this configuration, the excluded volume of the flow path or the liquid chamber generated by the second actuator can be increased.

In the droplet discharge head, the area where the second vibration plate forms the wall surface of the second inflow path may be larger than the area where the first vibration plate forms the wall surface of the first inflow path.

According to this configuration, the pressure fluctuation due to the second actuator is transmitted to the nozzle without passing through the first liquid chamber, and therefore compliance can be reduced.

In the droplet discharge head, a displacement amplifying mechanism includes a storage chamber in which a part of the wall surface is formed by the second vibration plate and a third vibration plate forming a part of the wall surface of a storage chamber, in which the area where the third vibration plate forms the wall surface of the storage chamber may be larger than the area where the first vibration plate forms the wall surface of the first liquid chamber, and the resonance frequency of the first actuator may be equal to the resonance frequency of the second actuator.

According to this configuration, it is possible to shorten the droplet discharge interval when executing continuous discharge while increasing the excluded volume generated by the second actuator.

In the droplet discharge head, the resonance frequency of the first actuator may be equal to the resonance frequency of the second actuator.

According to this configuration, it is possible to shorten the droplet discharge interval when executing continuous discharge while increasing the excluded volume generated by the second actuator.

In the droplet discharge head, the diameter of the droplet discharged from the nozzle may be less than two-thirds of the nozzle opening.

According to this configuration, since the inside of the pseudo nozzle diameter liquid film formed in the nozzle has a diameter that is two-thirds of the nozzle inner diameter, a liquid having a diameter less than two-thirds of the nozzle inner diameter can be discharged.

In the droplet discharge head, the speed at which the liquid column formed in the nozzle moves in the direction toward the nozzle opening may be higher than the speed at which the meniscus in the nozzle moves in the direction toward the nozzle opening.

According to this configuration, it is possible to promote separation of the liquid column from the liquid in the nozzle.

What is claimed is:

1. A droplet discharge head mounted on a droplet discharge apparatus including a control unit for controlling droplet discharge, the head comprising:

a first liquid chamber formed on a flow path forming substrate;

a nozzle communicating with the first liquid chamber;

a first inflow path for supplying a liquid to the first liquid chamber;

an outflow path communicating with the first liquid chamber, wherein the outflow path is different from the nozzle and the first inflow path;

a first vibration plate forming a part of a wall surface of the first liquid chamber;

a second vibration plate forming a part of a wall surface of the first inflow path;

a third vibration plate forming a part of a wall surface of the outflow path;

a first actuator for displacing the first vibration plate to change a pressure in the first liquid chamber; and a second actuator for displacing the second vibration plate to change the pressure in the first liquid chamber and for displacing the third vibration plate to change a volume of the outflow path, wherein an excluded volume of the second actuator is larger than that of the first actuator, based on a drive signal from the control unit, the second actuator is driven to draw a meniscus in the nozzle by depressurizing the inside of the first liquid chamber, and the first actuator is driven to discharge droplets from the nozzle by pressurizing the inside of the first liquid chamber.

2. The droplet discharge head according to claim 1, wherein an expansion/contraction amount of the second actuator is larger than that of the first actuator.

3. The droplet discharge head according to claim 1, wherein the second actuator displaces the second vibration plate via a displacement amplifying mechanism that increases a displacement amount of the second vibration plate with respect to an expansion/contraction amount of the second actuator.

4. The droplet discharge head according to claim 1, wherein the second vibration plate is a diaphragm.

5. The droplet discharge head according to claim 1, wherein the second vibration plate is a piston that reciprocates according to expansion and contraction of the second actuator.

6. The droplet discharge head according to claim 1, wherein an area where the second vibration plate forms the wall surface of the first inflow path is larger than an area where the first vibration plate forms the wall surface of the first liquid chamber.

7. The droplet discharge head according to claim 3, wherein the displacement amplifying mechanism includes a storage chamber in which a part of a wall surface is formed by the second vibration plate, and the third vibration plate forming a part of the wall surface of the storage chamber, an area where the third vibration plate forms the wall surface of the storage chamber is larger than an area where the first vibration plate forms the wall surface of the first liquid chamber, and a resonance frequency of the first actuator is equal to a resonance frequency of the second actuator.

8. The droplet discharge head according to claim 6, wherein a resonance frequency of the first actuator is equal to a resonance frequency of the second actuator.

9. The droplet discharge head according to claim 1, wherein a diameter of each droplet of the droplets discharged from the nozzle is less than two-thirds of an opening of the nozzle.

10. The droplet discharge head according to claim 1, wherein a speed at which a liquid column formed in the nozzle moves in a direction toward an opening of the nozzle is higher than a speed at which the meniscus in the nozzle moves in a direction toward the opening of the nozzle.

* * * * *